US010837134B2

(12) United States Patent
Lee et al.

(10) Patent No.: US 10,837,134 B2
(45) Date of Patent: Nov. 17, 2020

(54) WASHING MACHINE AND METHOD OF CONTROLLING THE SAME

(71) Applicant: LG ELECTRONICS INC., Seoul (KR)

(72) Inventors: Hoonbong Lee, Seoul (KR); Minho Jang, Seoul (KR); Jaegwang Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 248 days.

(21) Appl. No.: 15/715,517

(22) Filed: Sep. 26, 2017

(65) Prior Publication Data

US 2018/0087208 A1 Mar. 29, 2018

(30) Foreign Application Priority Data

Sep. 27, 2016 (KR) ..... 10-2016-0124080

(51) Int. Cl.
*D06F 34/18* (2020.01)
*D06F 33/00* (2020.01)
(Continued)

(52) U.S. Cl.
CPC ..... *D06F 34/18* (2020.02); *D06F 23/02* (2013.01); *D06F 33/00* (2013.01); *D06F 34/28* (2020.02);
(Continued)

(58) Field of Classification Search
CPC ..... D06F 39/003; D06F 34/18
See application file for complete search history.

(56) References Cited

U.S. PATENT DOCUMENTS 9,745,685 B2 8/2017 Jang et al.
2005/0028296 A1* 2/2005 Lee ..... D06F 37/203 8/158
(Continued)

FOREIGN PATENT DOCUMENTS

DE 198 57 903 6/1999
EP 1 995 366 11/2008
(Continued)

OTHER PUBLICATIONS

European Search Report dated Feb. 26, 2018 issued in European Application No. 17193132.2.
(Continued)

*Primary Examiner* — Spencer E Bell
(74) *Attorney, Agent, or Firm* — Ked & Associates, LLP

(57) ABSTRACT

A washing machine and a method of controlling the same are disclosed. The amount of laundry that is introduced into the washing machine is measured using gravity and inertia applied during the operation of a motor, whereby it is possible to precisely calculate the amount of laundry and to minimize the effects of the initial position of the laundry and the movement of the laundry. In addition, a current value of the motor that is operated is used to measure the amount of laundry without a sensor. Furthermore, precision in determining the amount of laundry is improved, and the amount of laundry is determined within a short time. Consequently, it is easy to commence the spin-drying operation, thereby reducing washing time and saving energy.

18 Claims, 15 Drawing Sheets

(51) Int. Cl.

| | |
|---|---|
| ***D06F 34/28*** | (2020.01) |
| ***D06F 23/02*** | (2006.01) |
| ***D06F 37/22*** | (2006.01) |
| ***D06F 37/30*** | (2020.01) |
| ***D06F 39/02*** | (2006.01) |
| ***D06F 39/04*** | (2006.01) |
| ***D06F 39/08*** | (2006.01) |
| ***D06F 37/26*** | (2006.01) |

(52) U.S. Cl.

CPC ..... *D06F 37/22* (2013.01); *D06F 37/266* (2013.01); *D06F 37/304* (2013.01); *D06F 39/022* (2013.01); *D06F 39/045* (2013.01); *D06F 39/085* (2013.01); *D06F 39/087* (2013.01); *D06F 2202/065* (2013.01); *D06F 2202/085* (2013.01); *D06F 2202/10* (2013.01); *D06F 2202/12* (2013.01); *D06F 2204/065* (2013.01)

(56) References Cited

U.S. PATENT DOCUMENTS

| | | | |
|---|---|---|---|
| 2005/0028299 | A1 | 2/2005 | Jeon et al. |
| 2012/0005840 | A1 | 1/2012 | Jang et al. |
| 2012/0324654 | A1 | 12/2012 | Koo et al. |
| 2014/0101865 | A1 | 4/2014 | Jang et al. |
| 2015/0051738 | A1* | 2/2015 | Lee ..... D06F 39/003 700/275 |

FOREIGN PATENT DOCUMENTS

| | | |
|---|---|---|
| EP | 2 354 296 | 8/2011 |
| EP | 02719813 | 4/2014 |
| EP | 2 837 732 | 2/2015 |
| KR | 10-2011-0048352 | 5/2011 |
| KR | 10-2012-0004272 | 1/2012 |
| KR | 10-1156710 | 6/2012 |
| KR | 10-2014-0045714 | 4/2014 |
| KR | 10-2015-0019649 | 2/2015 |
| WO | WO 2005/085511 | 9/2005 |
| WO | WO 2011/078611 | 6/2011 |

OTHER PUBLICATIONS

European Search Report dated Feb. 26, 2018 issued in European Application No. 17193773.3.

International Search Report (with English Translation) dated Jan. 19, 2018 issued in Application No. PCT/KR2017/010676.

European Search Report dated Jan. 30, 2018 issued in Application No. 17193776.6.

* cited by examiner (a)

(b)

WASHING MACHINE AND METHOD OF CONTROLLING THE SAME

CROSS-REFERENCE TO RELATED APPLICATION

This application claims priority under 35 U.S.C § 119 to Korean Application No. 10-2016-0124080, filed on Sep. 27, 2016, whose entire disclosure is hereby incorporated by reference.

BACKGROUND

1. Field

The present disclosure relates to a washing machine and a method of controlling the same, and more particularly to a washing machine capable of sensing the amount of laundry that is introduced thereinto and a method of controlling the same.

2. Background

In general, a washing machine is an apparatus that treats laundry through various processes, such as washing, spin drying, and/or drying.

A predetermined amount of wash water is supplied into a drum containing laundry therein. An appropriate amount of detergent is dissolved in the wash water to remove contaminants from the laundry through the chemical action of the detergent. In addition, the drum, in which the laundry is contained, is rotated to easily remove contaminants from the laundry through the mechanical friction between the wash water and the laundry and vibration of the laundry.

In order to remove contaminants from the laundry, a washing cycle, a rinsing cycle, and a spin-drying cycle are performed. During washing of the laundry, a spin-drying operation is performed in the washing cycle and the rinsing cycle as well as in the spin-drying cycle in order to remove water from the laundry.

In the spin-drying operation, a motor is rotated at a high speed. As a result, centrifugal force is applied to the laundry in the drum, whereby water is removed from the laundry.

The spin-drying operation is affected by the amount of laundry and the tangling of laundry, since the motor is rotated at a high speed. As the amount of laundry increases, it is difficult to rotate the motor at a high speed. Furthermore, if the laundry is tangled and is thus collected at one side, the washing machine may be damaged due to unbalance when the motor is rotated at a high speed. Consequently, the washing machine precisely determines the amount of laundry before the execution of spin drying so as to adjust the rotational speed of the motor for spin drying based on the amount of laundry.

In a conventional washing machine, current supplied to the motor at the time of starting the motor, which is in a stationary state, is measured in order to determine the amount of laundry. If the amount of laundry is determined at the time of starting the motor, it is difficult to determine a small amount of laundry. In addition, the amount of laundry that is measured may be changed due to the initial position of laundry in a stationary state and the movement of the laundry caused by driving the motor. Particularly, as the amount of laundry increases, variation in the measured value is increased.

In addition, for a washing machine including a sensorless motor, positional alignment is difficult at the time of starting the motor, whereby variation in the measured amount of laundry is increased. If the variation in the measured amount of laundry is increased, it is not possible to determine the amount of laundry based on calculated data.

If the amount of laundry is not precisely measured, it takes a lot of time to perform the spin-drying operation, in which the motor is rotated at a high speed. As a result, the washing time increases, whereby energy consumption increases.

BRIEF DESCRIPTION OF THE DRAWINGS

The embodiments will be described in detail with reference to the following drawings in which like reference numerals refer to like elements, and wherein.

DETAILED DESCRIPTION

Figure 1:
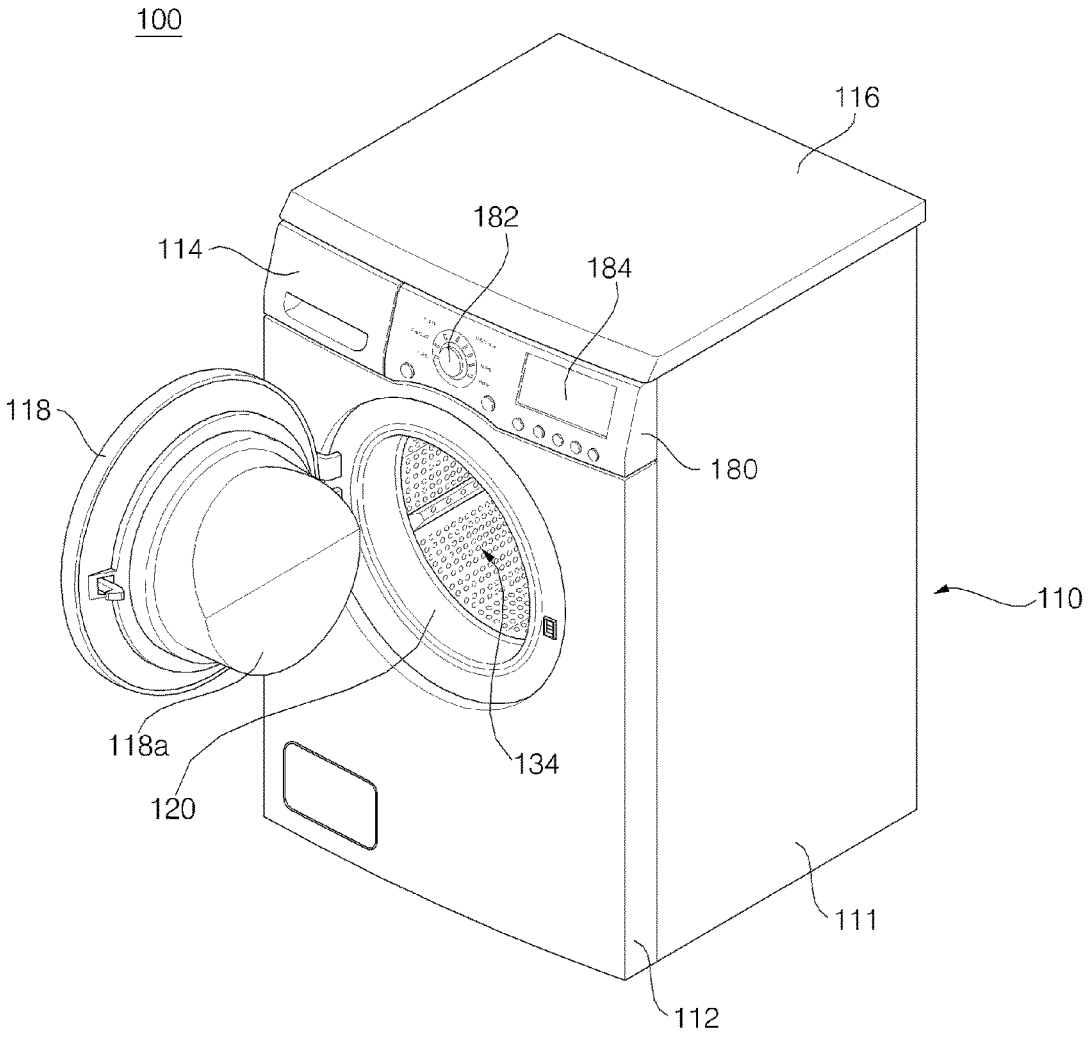
FIG. 1 is a perspective view showing a washing machine according to an embodiment of the present disclosure.
Figure 2:
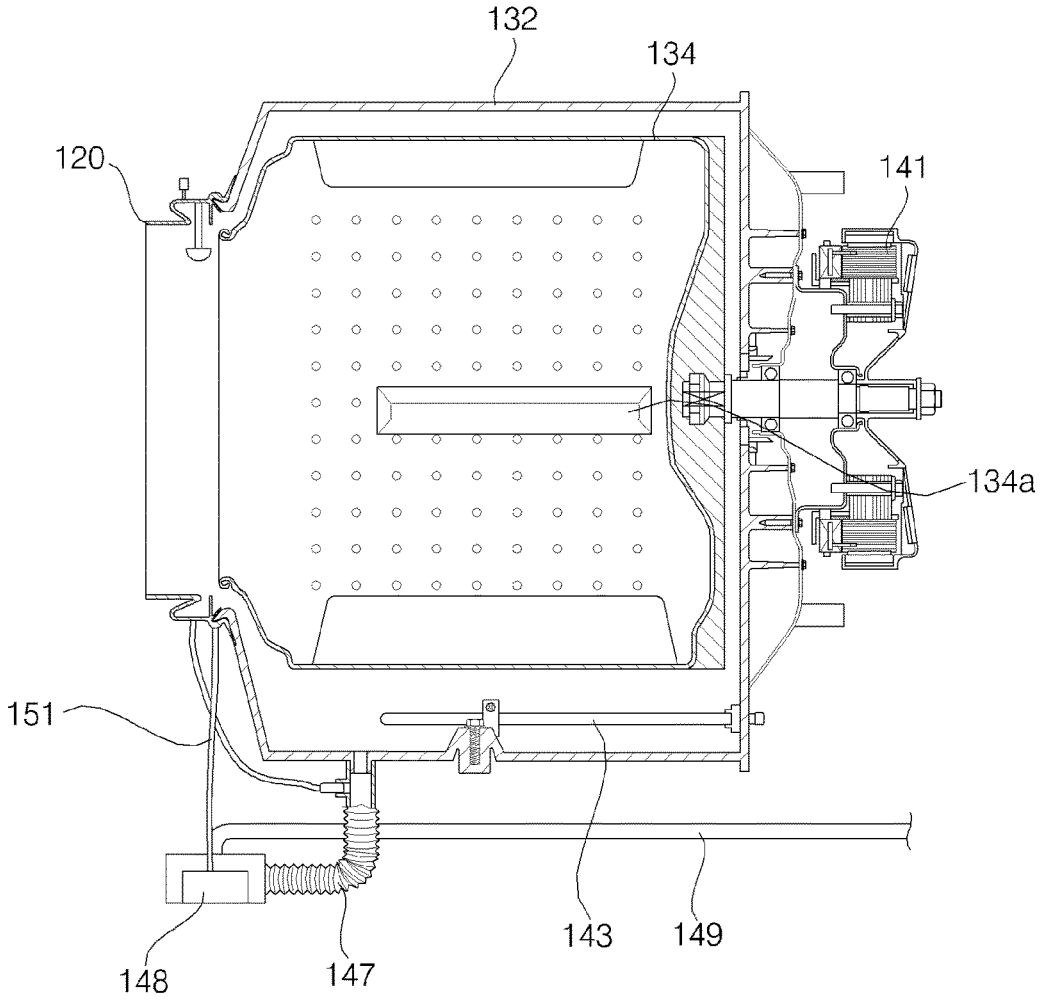
FIG. 2 is a partial sectional view of the washing machine shown in FIG. 1.

FIG. 1 is a perspective view showing a washing machine according to an embodiment of the present disclosure, and FIG. 2 is a partial sectional view of the washing machine shown in FIG. 1. A washing machine 100 according to the present disclosure is configured as shown in FIGS. 1 and 2.

A casing 110 defines the external appearance of the washing machine 100. A tub 132 for containing water is provided in the casing 110 in a suspended state, and a drum 134 for containing laundry is rotatably provided in the tub 132. A heater 143 for heating the water in the tub 132 may be further provided.

The casing 110 may include a cabinet 111 that defines the external appearance of the washing machine 100, the cabinet 111 having an open front and top, a base (not shown) for supporting the cabinet 111, a front cover 112 coupled to the front of the cabinet 111, the front cover 112 being provided with a laundry introduction hole, through which laundry is introduced, and a top cover 116 provided at the top of the cabinet 111. A door 118 for opening and closing the laundry introduction hole may be provided at the front cover 112.

The door 118 may be provided with a glass 118*a* such that the laundry in the drum 134 is visible from outside the washing machine 100. The glass 118*a* may be convex. In the state in which the door 118 is closed, the tip end of the glass 118*a* may protrude to the inside of the drum 134.

A detergent box 114 contains additives, such as preliminary or main washing detergent, fabric softener, and bleach. The detergent box 114 is provided in the casing 110 so as to be capable of being withdrawn therefrom. The detergent box 114 may be partitioned into a plurality of containing spaces, in which the additives are individually contained without being mixed.

In order to absorb vibration generated during the rotation of the drum 134, the tub 132 may be suspended from the top cover 116 via a spring. In addition, a damper may be further provided to support the tub 132 at the lower side thereof.

The drum 134 may be provided with a plurality of holes therein such that water flows between the tub 132 and the drum 134. One or more lifters 134*a* may be provided on the inner circumferential surface of the drum 134 such that laundry is lifted up and dropped during the rotation of the drum 134. The drum 134 may not be provided completely horizontally, but may be provided at a predetermined inclination such that the rear part of the drum 134 is lower than the horizontal line.

A motor for generating driving force necessary to rotate the drum 134 may be provided. The washing machine may be classified as a direct-driving-type washing machine or an indirect-driving-type washing machine depending on how the driving force generated by the motor is transmitted to the drum 134. In the direct-driving-type washing machine, a rotary shaft of the motor is directly fastened to the drum 134. The rotary shaft of the motor and the center of the drum 134 are aligned with each other on the same line. In the direct-driving-type washing machine, the drum 134 is rotated by a motor 141 provided in a space between the rear of the tub 132 and the cabinet 111.

In the indirect-driving-type washing machine, the drum 134 is rotated using a power transmission means, such as a belt or a pulley, for transmitting the driving force generated by the motor. The rotary shaft of the motor and the center of the drum 134 are not necessarily aligned with each other on the same line. The washing machine according to the present disclosure may be either a direct-driving-type washing machine or an indirect-driving-type washing machine.

A gasket 120 is provided between the casing 110 and the tub 132. The gasket 120 prevents the water contained in the tub 132 from leaking to a space between the tub 132 and the casing 110. One side of the gasket 120 is coupled to the casing 110, and the other side of the gasket 120 is coupled to the circumference of the open front of the tub 132. In addition, the gasket 120 is compressed according to the vibration of the tub 132 to absorb the vibration. The gasket 120 may be made of a deformable or flexible material that is somewhat elastic. For example, the gasket 120 may be made of natural rubber or synthetic resin.

The washing machine is connected to a hot water source H.W. for supplying hot water and a cold water source C.W. for supplying cold water via a hot water hose and a cold water hose, respectively. Water introduced via the hot water hose and the cold water hose is supplied to the detergent box 114, a steam generator, and/or a swirl nozzle under the control of a water supply unit.

A pump 148 drains water discharged from the tub 132 through a drain bellows 147 to the outside via a drain hose 149 or sends the water to a circulation hose 151. In this embodiment, the pump 148 performs both the function of a drain pump and the function of a circulation pump. Alternatively, a drain pump and a circulation pump may be provided separately.

During the rotation of the drum 134, laundry is repeatedly lifted up by the lifters 134*a* and dropped. When the drum is rotated at a high speed, the laundry clings to the wall of the drum. At this time, wash water is separated from the laundry by centrifugal force, and is discharged to the tub through the holes formed in the drum. In this way, spin drying is performed.

A control panel 180 may include a course selection unit 182 for allowing a user to select a course and an input and output unit 184 for allowing the user to input various control commands and displaying the operating state of the washing machine 100.

The gasket 120 may be provided with a separation-preventing protrusion for preventing the laundry from escaping from the drum 134 and thus being caught between the gasket 120 and the casing 110, particularly the front cover 112, as the result of rotation of the drum 134 or preventing the laundry from being discharged to the outside when the door 118 is opened after the completion of washing. The separation-preventing protrusion is formed on the inner circumferential surface of the gasket 120 so as to protrude toward the laundry introduction hole.

Figure 3:
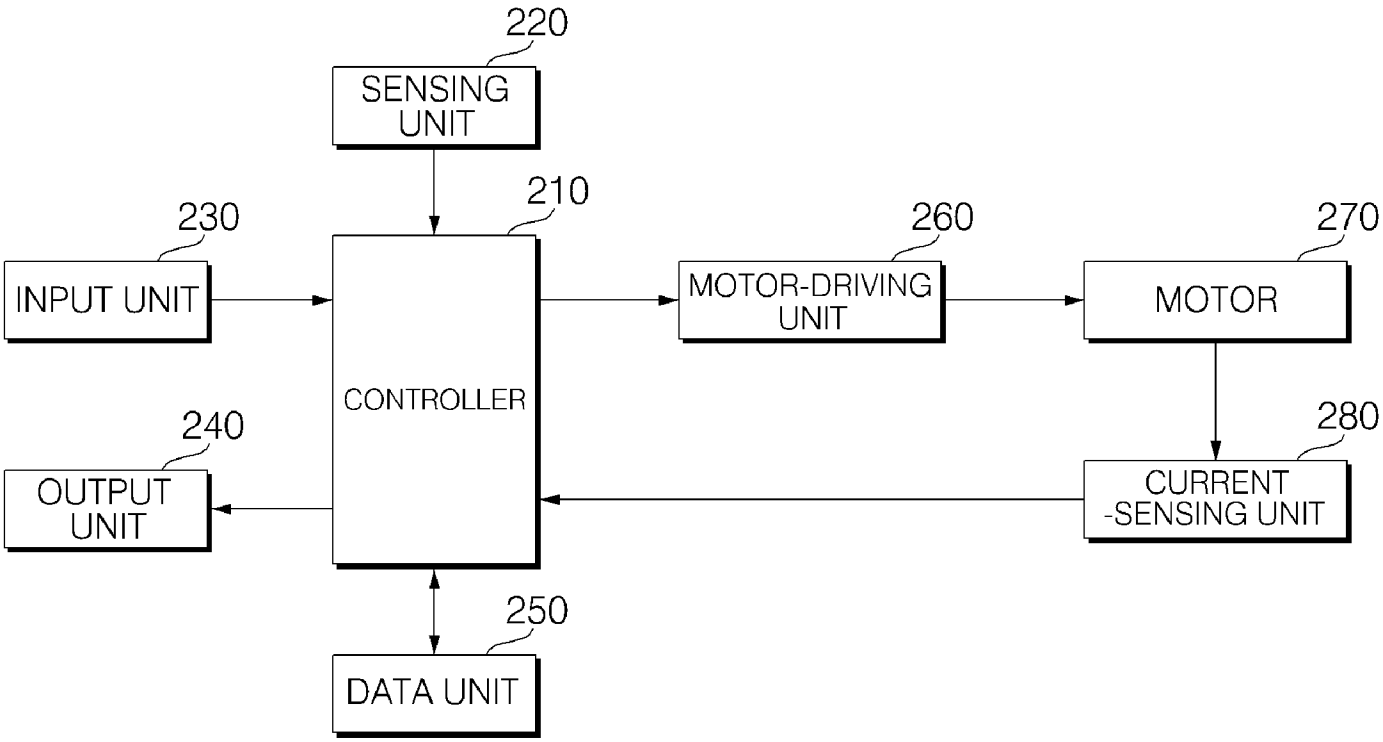
FIG. 3 is a block diagram showing a control construction of the washing machine according to an embodiment of the present disclosure.

FIG. 3 is a block diagram showing a control construction of the washing machine according to an embodiment of the present disclosure. As shown in FIG. 3, the washing machine 100 includes an input unit 230, an output unit 240, a sensing unit 220, a motor-driving unit 260, a motor 270, a current-sensing unit 280, a data unit 250, and a controller 210 for controlling the overall operation of the washing machine, in addition to the structural elements described above.

In addition, the controller 210 controls a water supply valve and a drain valve. The washing machine may further include a control construction for heating wash water. Depending on the circumstances, a communication unit for transmitting and receiving data to and from the outside may be further provided. However, a description thereof will be omitted. The controller 210 may be realized by one or more processors or a hardware device.

The input unit 230, including an input means, such as at least one button, a switch, and a touchpad, allows the user to input operation settings, such as a power on/off input, a washing course, a water level, and a temperature. The output unit 240 includes a display unit for displaying information about the operation setting input through the input unit 230 and outputting the operating state of the washing machine.

In addition, the output unit 240 further includes a speaker or a buzzer for outputting a predetermined sound effect or alarm.

The data unit 250 stores control data for controlling the operation of the washing machine, data on the input operation setting, data on the washing course, and reference data for determining whether error has occurred in the washing machine. In addition, the data unit 250 stores data that is sensed or measured by the sensing unit during the operation of the washing machine.

The data unit 250 stores various kinds of information necessary to control the washing machine. The data unit 250 may include a volatile or nonvolatile recording medium. The recording medium stores data that can be read by the microprocessor. The recording medium may include a hard disk drive (HDD), a solid-state disk (SSD), a silicon disk drive (SDD), a ROM, a RAM, a CD-ROM, a magnetic tape, a floppy disk, and an optical data storage device.

The sensing unit 220, including a plurality of sensors, measures the voltage or current of the washing machine, and senses data, such as the rotational speed of the motor, the temperature of wash water, the level of the wash water, and the pressure of the wash water that is supplied or drained, which are transmitted to the controller 210. The sensing unit 220 includes a plurality of sensors, each of which may be selected from among a current sensor (e.g., current sensor or current sensing unit 280), a voltage sensor, a water level sensor, a temperature sensor, a pressure sensor, and a speed sensor.

The water level sensor is mounted in the drum or the tub to sense the level of wash water and transmit water level data to the controller 210. The temperature sensor measures the temperature of wash water. In addition, a plurality of temperature sensors may be provided at different positions to sense the temperature in a control circuit and the temperature of a heater for heating or drying wash water, if the heater is provided, as well as to sense the temperature of wash water. The current-sensing unit (or current sensor) 280 measures the current that is supplied to the motor, and transmits the measured current to the controller 210.

The motor 270 is connected to the drum to generate power necessary to rotate the drum. A sensorless motor may be used as the motor 270. The motor-driving unit (or power supply) 260 supplies operating power to the motor 270. The motor-driving unit 260 controls the motor to operate or stop in response to a control command from the controller 210. In addition, the motor-driving unit 260 controls the rotational speed of the motor.

The motor-driving unit 260 controls the rotational direction, rotational angle, and rotational speed of the motor 270 in response to a control command from the controller 210. In addition, the motor-driving unit 260 controls the motor 270 to operate differently based on a predetermined washing course and on each of the washing, rinsing, and spin-drying cycles that are performed. At this time, the motor-driving unit 260 controls the rotational direction, rotational angle, and rotational speed of the motor 270 variably such that the wash water in the drum forms a specific form of water current.

The controller 210 controls water supply and drainage depending on the operation setting input through the input unit 230. In addition, the controller 210 generates a control command such that the drum is rotated to perform washing according to the operation of the motor 270, and transmits the control command to the motor-driving unit 260. The controller 210 may control a series of washing processes, such as washing, rinsing, and spin drying.

The controller 210 stores the received operation setting to the data unit 250, and outputs the operation setting or the operating state of the washing machine through the output unit 240. Depending on the circumstances, in the case in which there is a terminal that has a washing machine control application installed therein and is wirelessly connected to the washing machine, the controller may transmit data on the operation setting to the terminal.

While washing is being performed, the controller 210 determines whether the washing is being performed normally based on data received from the sensors of the sensing unit 220 and data received from the current-sensing unit 280. Upon determining that the washing is being abnormally performed, the controller 210 outputs error through the output unit 240.

For example, when the level of wash water does not reach a predetermined water level within a water supply time during the supply of water, when the level of wash water does not reach an empty water level within a predetermined drainage time while the water is being drained, when the empty water level is sensed during the execution of washing, when the temperature of wash water does not reach a predetermined temperature, or when spin drying is not performed a predetermined number of times or within a predetermined amount of time, the controller 210 determines that error has occurred.

The controller 210 transmits a control command to the motor-driving unit 260 such that a washing, rinsing, or spin-drying process is performed according to the operation setting. When the motor is operated, the controller 210 stores and analyzes a current value received from the current-sensing unit 280 to determine the state of the motor and, in addition, to determine the amount of laundry contained in the drum. In addition, the controller 210 determines deviation of laundry, i.e. the unbalance of laundry, based on the measured current.

When washing is commenced and the drum is rotated at a high speed, the controller 210 determines the amount of laundry in the drum. Even after the controller 210 has determined the amount of laundry, the controller 210 determines the amount of laundry again before high-speed rotation of the drum when the high-speed rotation of the drum is needed such that the drum is rotated at a high speed in response to the determined amount of laundry. The controller 210 may change and set the maximum rotational speed in response to the determined amount of laundry.

When the motor is rotated by the motor-driving unit 260, the controller 210 transmits a control command to the motor-driving unit 260 such that the rotational speed of the motor increases or decreases stepwise. During the rotation of the motor, the controller 210 analyzes the current value received from the current-sensing unit 280 in an acceleration period, a maintenance period, and a deceleration period in order to determine the amount of laundry. The controller 210 calculates gravity and inertial force applied to the drum during the rotation of the motor and counter-electromotive force generated when the motor is braked to determine the amount of laundry.

Figure 4:
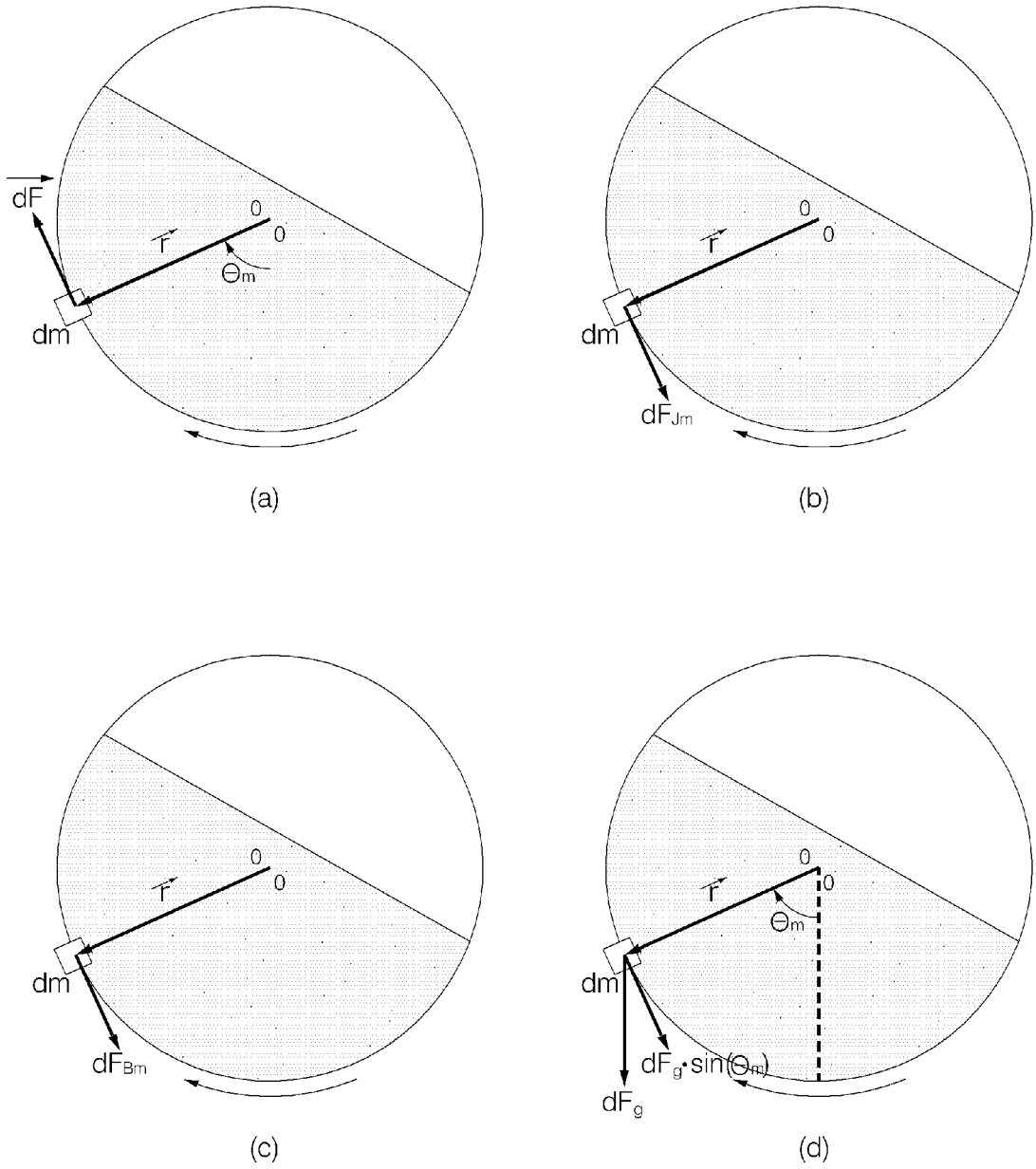
FIG. 4 is a reference view illustrating the application of force to laundry in the washing machine according to the embodiment of the present disclosure.

FIG. 4 is a reference view illustrating the application of force to laundry in the washing machine according to the embodiment of the present disclosure. As previously described, the controller 210 determines the amount of laundry using the force applied to the drum.

As shown in FIG. 4, various forces are applied to the drum, in which laundry is placed. The washing machine separates foreign matter from the laundry and removes wash water from the laundry using the rotation of the drum.

Consequently, motor torque, inertial torque, frictional torque, and load torque are applied to rotate the drum.

The motor torque is force that is applied to rotate the motor, which is connected to the drum. The inertial torque is force that impedes the rotation of the drum due to inertia, by which the existing operating state (rotation) is maintained, when the drum is accelerated or decelerated during the rotation of the drum. The frictional torque is force that impedes the rotation of the drum due to the friction between the drum and the laundry, between the door and the laundry, or between individual laundry items. The load torque is force that impedes the rotation of the drum due to the weight of laundry.

The washing machine does not determine the amount of laundry at the time of starting the motor but determines the amount of laundry during the rotation of the drum. Hereinafter, therefore, the application of force to laundry at an angle θm will be described by way of example.

As shown in FIG. 4(*a*), motor torque Te is force necessary at the time of operating the motor. Consequently, the motor torque Te is expressed as the sum of inertial torque, frictional torque, and load torque. The motor torque Te is the product of force necessary to lift up the laundry and the radius r of the drum.

As shown in FIG. 4(*b*), inertial torque Jm is applied as force that impedes the rotation of the drum due to inertia based on the distribution of the laundry in the drum when the drum is accelerated or decelerated during the rotation of the drum. At this time, the inertial torque is proportional to mass m and the square of the radius of the drum.

As shown in FIG. 4(*c*), frictional torque Bm is frictional force that is applied between the laundry and the tub and between the laundry and the door. Consequently, the frictional torque is proportional to rotational speed Wm. The frictional torque may be the product of the coefficient of friction and the rotational speed.

As shown in FIG. 4(*d*), load torque TL is gravity that is applied depending on the distribution of the laundry at the time of starting the motor. The load torque may be calculated from the weight (mass m) of the laundry, acceleration due to gravity g, the radius r of the drum, and the angle θm.

Force applied to the laundry at the angle θm is basically force Fg due to gravity. Since the drum is rotated, however, the force may be calculated as the product of the gravity and sin(θm) due to the rotation of the drum. The force Fg due to gravity is decided by acceleration due to gravity, the radius of the drum, and the mass of the laundry.

During the rotation of the drum, the motor torque, the inertial torque, the frictional torque, and the load torque are applied simultaneously. These force components are reflected in the current value of the motor. Consequently, the controller 210 calculates the amount of laundry using the current value measured by the current-sensing unit during the operation of the motor.

The motor torque is greatly affected by gravity due to the weight of the laundry. When the weight of the laundry exceeds a predetermined weight, resolution is lowered. That is, if the amount of laundry exceeds a predetermined level, discrimination due to the weight of the laundry is reduced as the amount of laundry increases.

When there is friction between the laundry and the door and when the laundry is caught in the door, a change in the value of the frictional torque increases, with the result that the frictional torque is distributed. Particularly, when the amount of laundry increases, the distribution of the frictional torque greatly increases.

The value of the load torque is deviated due to the movement of the laundry. In addition, when the weight of the laundry exceeds a predetermined level, the movement of the laundry is reduced. As a result, the load torque is reduced. In contrast, the inertial torque exhibits linearity with respect to the amount (weight) of laundry, although the inertial torque is affected by the movement of the laundry. Consequently, it is possible to more precisely measure the amount of laundry.

Since the inertial torque is resting force, the inertial torque is applied at the time of acceleration or deceleration. That is, the inertial torque is applied in the acceleration period and the deceleration period. In the case in which the rotational speed is uniform, however, no inertial torque is applied, and the motor torque, the frictional torque, and the load torque are applied.

The characteristics of the inertial torque may be calculated by excluding data in the maintenance period from data in the acceleration period and the deceleration period. Inertia may be calculated by subtracting the current value in the maintenance period from the current value in the acceleration period and the current value the deceleration period, dividing the resultant value by the variation of speed per unit time, i.e. acceleration, and multiplying the resultant value by counter-electromotive force.

Consequently, the washing machine may analyze the force applied in the acceleration period, the deceleration period, and the maintenance period to determine the amount of laundry based on the inertial torque. In addition, the washing machine may calculate gravity depending on the amount of laundry in the maintenance period. In addition, the washing machine may calculate counter-electromotive force generated by braking in the deceleration period in order to calculate the amount of laundry.

In addition, since the washing machine measures the current value during the rotation of the motor in order to calculate a laundry-amount sensing value, error due to the alignment of the motor at the time of starting the motor may be eliminated. In addition, the laundry moves uniformly without the change of a load, i.e. without irregular movement of the laundry, in the maintenance period, whereby it is possible to minimize error due to the change of the load.

At this time, the washing machine differently applies laundry amount data for calculating the laundry-amount sensing value in the maintenance period and laundry amount data for calculating the laundry-amount sensing value in the acceleration and deceleration periods. In the maintenance period, the characteristics of inertia are not included. In the acceleration period and the deceleration period, inertia is applied. Consequently, the laundry-amount sensing values are calculated based on different data and compared with each other to determine the final amount of laundry.

Figure 5:
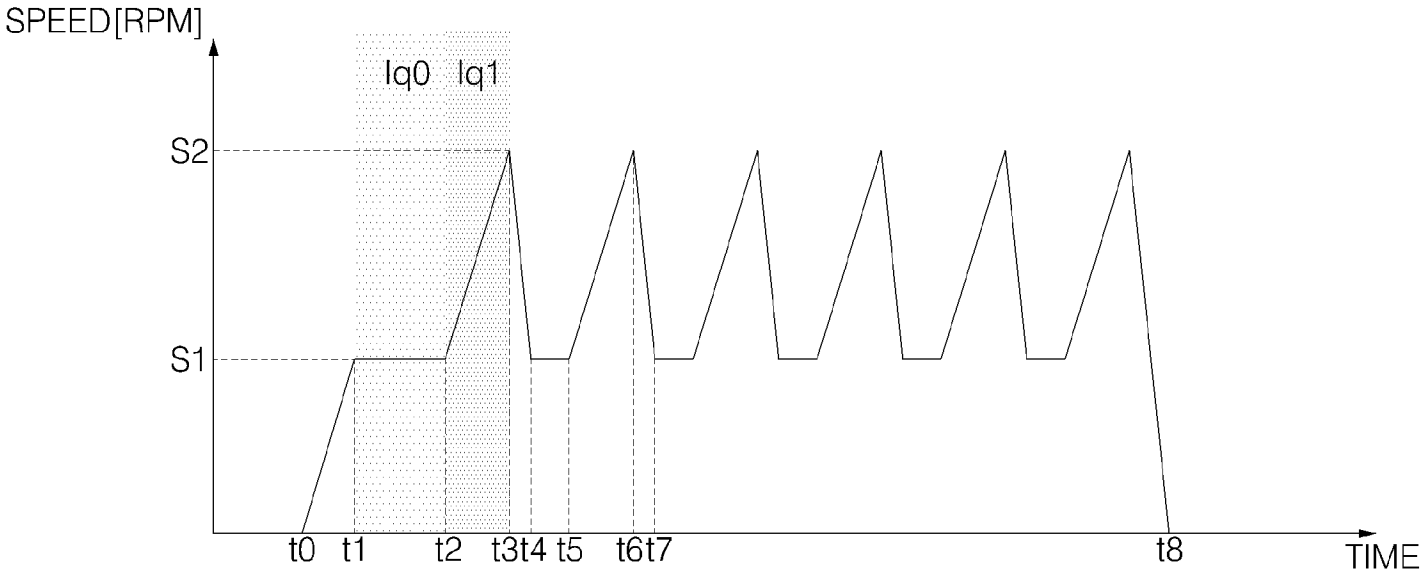
FIG. 5 is a reference view illustrating a method of measuring the amount of laundry in the washing machine according to the embodiment of the present disclosure.

FIG. 5 is a reference view illustrating a method of measuring the amount of laundry in the washing machine according to the embodiment of the present disclosure. As shown in FIG. 5, the controller 210 controls the rotational speed of the motor in order to determine the amount of laundry.

As previously described, the controller 210 calculates the inertial torque applied during the operation of the motor to determine the amount of laundry. Consequently, the controller 210 performs control to accelerate or decelerate the motor after the rotational speed of the motor is increased to a predetermined rotational speed. The controller 210 divides the maintenance period, the acceleration period, and the deceleration period from each other based on the rotational speed of the motor, and determines the amount of laundry using current values Iq0 and Iq1 measured in the respective periods during the operation of the motor.

The controller 210 calculates the amount of laundry using the frictional torque and the load torque, which are affected by gravity in the maintenance period, in which the motor is rotated at a low speed, accelerates the motor from the maintenance period such that the characteristics of the inertial torque are emphasized at a rotational speed of the motor that is higher than that in the maintenance period to determine the amount of laundry in the acceleration period and the deceleration period, and analyzes the two data to determine the amount of laundry.

In addition, the controller 210 performs control such that the rotational speed of the motor is repeatedly maintained, accelerated, and decelerated a predetermined number of times after the rotational speed of the motor has reached the predetermined rotational speed. While the rotational speed of the motor is repeatedly maintained, accelerated, and decelerated, the controller 210 stores the measured current value on a per-period basis and calculates the average thereof to determine the amount of laundry.

At this time, the controller 210 may calculate the amount of laundry by subtracting the current value in the maintenance period from the current value in the acceleration period and multiplying the resultant value by counter-electromotive force. The average value in each period is used as the current value. The counter-electromotive force is electromotive force that is generated by current formed from the motor in the opposite direction when the motor is braked. The controller 210 compares the current values in the acceleration period and the maintenance period with each other and calculates the counter-electromotive force in the deceleration period to determine the amount of laundry.

In order to determine the amount of laundry, the controller 210 transmits a control command to the motor-driving unit 260 to control the rotational speed of the motor. The controller 210 sets the rotational speed of the motor at which the laundry tumbles in the rotating drum as a first speed S1. In addition, the controller 210 sets the rotational speed of the motor at which the laundry starts to cling to the wall of the drum by centrifugal force generated in the drum as the rotational speed of the motor increases, at which some of the laundry rotates along with the drum in the state of clinging to the wall of the drum, and at which some of the laundry is lifted up and dropped by the rotation of the drum as a second speed S2.

For example, the first speed may be set in the range from 30 rpm to 40 rpm, and the second speed may be set in the range from 60 rpm to 80 rpm. The first speed and the second speed may be changed depending on the size of the drum and the kind and performance of the motor.

In response to the control command, the motor-driving unit 260 starts the motor at a zero time t0, and accelerates the motor until the rotational speed of the motor reaches the first speed S1. When the rotational speed of the motor reaches the first speed, the motor-driving unit 260 maintains the first speed for a predetermined amount of time t1 to t2 in response to the control command. The first to second times t1 to t2 are a maintenance period, in which the rotational speed of the motor is maintained.

In addition, the motor-driving unit 260 accelerates the motor to the second speed S2 at the second time t2. When the rotational speed of the motor reaches the second speed S2 at a third time t3, the motor-driving unit 260 brakes the motor to decelerate the rotational speed of the motor to the first speed S1.

The current-sensing unit 280 measures the current value Iq0 during the maintenance period of the first to second times t1 to t2, measures the current value Iq1 during the acceleration period of the second to third times t2 to t3, and transmits the measured current values to the controller 210.

The current-sensing unit 280 measures current during the deceleration period, in which the rotational speed of the motor is reduced, after the third time t3, and the controller 210 calculates counter-electromotive force.

When the rotational speed of the motor reaches the first speed S1 at a fourth time t4, the motor-driving unit 260 maintains the rotational speed of the motor at the first speed in response to the control command (t4 to t5), and accelerates the rotational speed of the motor to the second speed (t5 to t6). When the rotational speed of the motor reaches the second speed, the motor-driving unit 260 decelerates the rotational speed of the motor to the first speed (t6 to t7). In this way, the motor-driving unit 260 repeatedly controls the rotational speed of the motor 270 and then stops the motor (t8). This control is repeated 5 to 7 times.

The controller 210 performs control such that the rotational speed of the motor is repeatedly maintained, accelerated, and decelerated a predetermined number of times in the period between the first speed S1 and the second speed S2. The controller 210 maintains, accelerates, or decelerates the rotational speed of the motor in the state in which the motor does not stop but rotates. Consequently, initial starting force generated when the motor is started in the state of being stopped and error generated due to the movement of the laundry are excluded, and the controller 210 determines the amount of laundry using the inertial torque through the difference between the maintenance and acceleration periods.

In addition, the controller 210 repeats the above operation a predetermined number of times to calculate the average values in the maintenance, acceleration, and deceleration periods to thus determine the amount of laundry.

Figure 6:
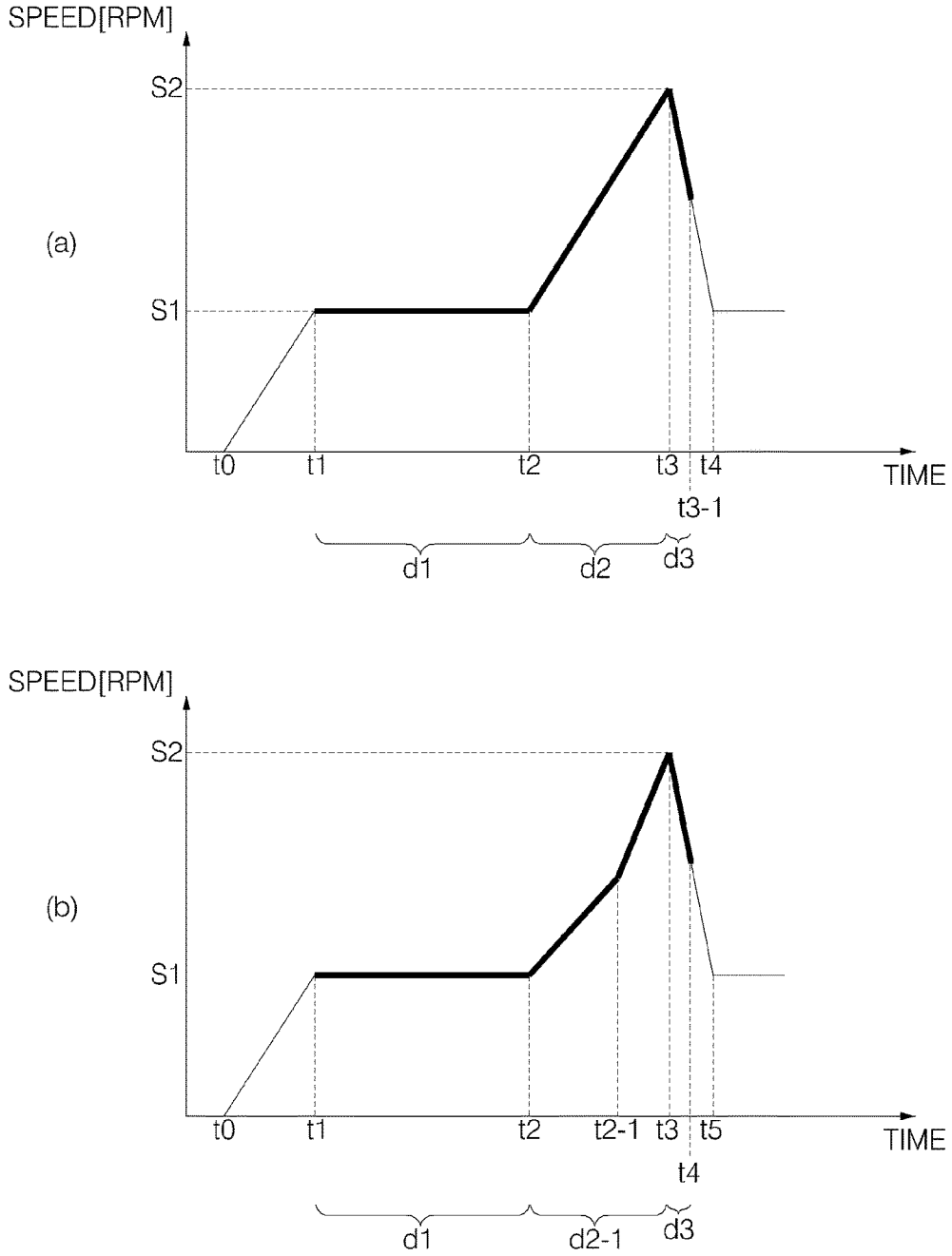
FIG. 6 is a view showing an example in which the speed of a motor is changed when the amount of laundry is measured in FIG. 5.

FIG. 6 is a view showing an example in which the speed of the motor is changed when the amount of laundry is measured in FIG. 5. As shown in FIG. 6(*a*), in controlling the rotational speed of the motor, the motor-driving unit 260 repeatedly maintains, accelerates, or decelerates the rotational speed of the motor 270 within a range between the first speed S1 and the second speed S2.

The motor-driving unit 260 maintains the rotational speed of the motor at the first speed S1 during a maintenance period d1 of first to second times t1 to t2, accelerates the rotational speed of the motor to the second speed during an acceleration period d2 of second to third times t2 and t3, and decelerates the rotational speed of the motor to the first speed S1 after the third time t3, at which the rotational speed of the motor has reached the second speed.

At this time, the maintenance period is set in the range from about 2 to 3 seconds. The deceleration period is shorter than the acceleration period, since counter-electromotive force is generated as the result of braking the motor in the deceleration period, whereby deceleration is performed within a short time. The maintenance period d1 after initial starting and the maintenance period after deceleration may have different lengths (times).

The motor-driving unit 260 uniformly increases the rotational speed of the motor during the acceleration period d2 such that the rotational speed of the motor reaches the second speed. At this time, counter-electromotive force is calculated for an amount of time ranging from time ranging from the third time t3 to a 3-1 time t3-1, which is a portion of the period from the third time to a fourth time t4, at which the rotational speed of the motor reaches the first speed. Depending on the circumstances, the counter-electromotive force may be calculated for an amount of time ranging from time ranging from the third time to the fourth time.

In addition, as shown in FIG. 6(*b*), in the case in which the amount of laundry is large, the motor-driving unit 260 does not accelerate the rotational speed of the motor at all once but changes acceleration to gradually increase the rotational speed of the motor to the second speed in an acceleration period d2-1.

For example, in the case in which the rotational speed of the motor is increased from the first speed S1 to the second speed S2 after the maintenance period of the first to second times t1 to t2, the motor-driving unit 260 may change the acceleration of the rotational speed during the acceleration period d2-1 such that the rotational speed of the motor reaches the second speed.

In the case in which the time during which the speed is increased exceeds a predetermined amount of time while the rotational speed of the motor is increased at the second time, the motor-driving unit 260 may change acceleration at a 2-1 time t2-1 such that the rotational speed of the motor is increased to the second speed. Even when the acceleration is changed in the acceleration period d2-1, the controller 210 calculates the average of the current values measured in the acceleration period d2-1 to determine the amount of laundry.

Figure 7:
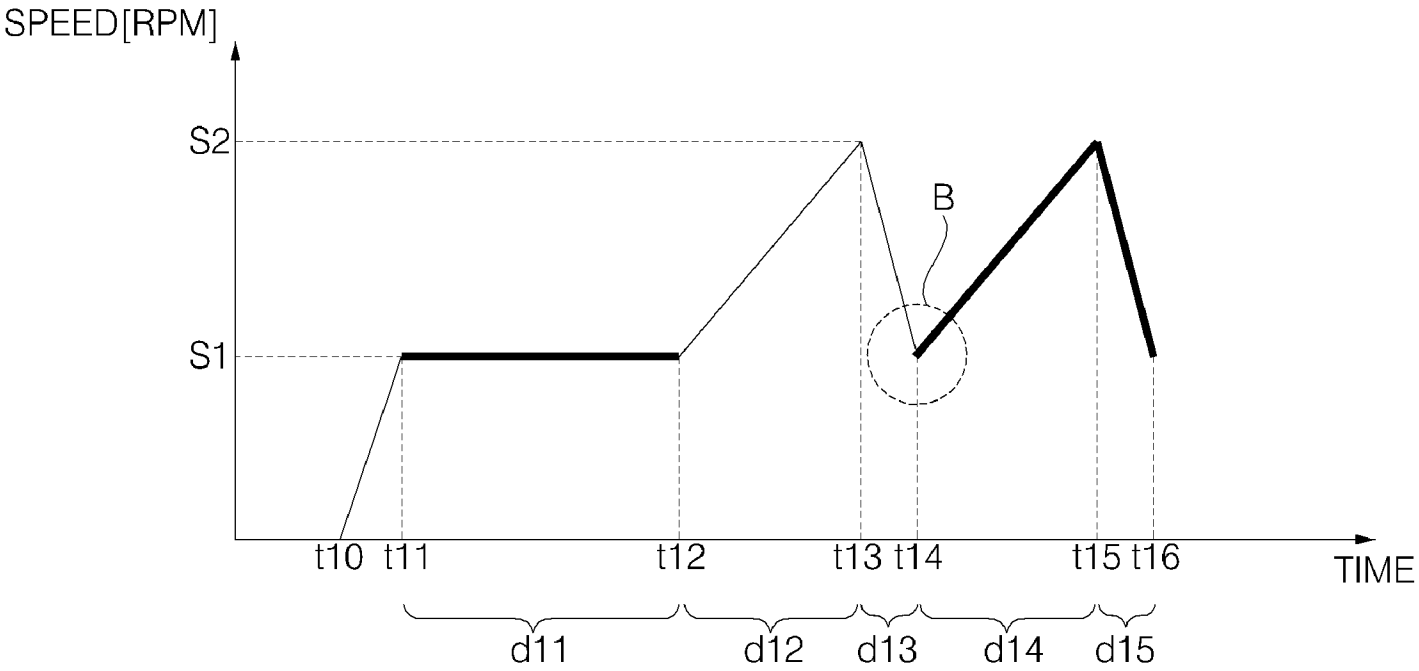
FIG. 7 is a view showing another example in which the speed of the motor is changed when the amount of laundry is measured in the washing machine according to the embodiment of the present disclosure.

FIG. 7 is a view showing another example in which the speed of the motor is changed when the amount of laundry is measured in the washing machine according to the embodiment of the present disclosure. The controller 210 may control the rotational speed of the motor, as shown in FIG. 7, in order to determine the amount of laundry.

After the motor is started, the controller 210 controls the rotational speed of the motor to be maintained at the first speed S1 for a predetermined amount of time. Afterward, the controller 210 controls the rotational speed of the motor to be accelerated or decelerated within a range of the first speed to the second speed with no maintenance period.

The washing machine determines the amount of laundry using inertia and gravity. However, the inertia, which is applied at the time of acceleration or deceleration and has strongly linear characteristics depending on the determination of the amount of laundry, is used. In addition, the current value in the maintenance period can be measured only once at the initial stage, since data in the maintenance period is narrowly distributed.

The controller 210 maintains the rotational speed of the motor for a predetermined amount of time only once at the initial stage to measure the current value in the maintenance period. Afterward, the controller 210 performs control such that the motor is repeatedly accelerated or decelerated with no maintenance period.

In response to the control command from the controller, therefore, the motor-driving unit 260 starts the motor at a tenth time t10 to accelerate the motor to the first speed S1, and maintains the rotational speed of the motor for an amount of time ranging from time ranging from eleventh to twelfth times t11 to t12.

The current-sensing unit 280 measures current in a maintenance period d11. In addition, the motor-driving unit 260 accelerates the rotational speed of the motor to the second speed S2 at the twelfth time t12. When the rotational speed of the motor reaches the second speed S2 at a thirteenth time t13, the motor-driving unit 260 decelerates the rotational speed of the motor to the first speed S1.

The current-sensing unit 280 measures current in an acceleration period d12 and a deceleration period d13 of the twelfth to thirteenth times t12 to t13. In the deceleration period d13, counter-electromotive force is calculated. Depending on the circumstances, the controller 210 may use data in a subsequent acceleration period d14 and a subsequent deceleration period d15, excluding data in the acceleration period d12 and the deceleration period d13, in order to more precisely determine the amount of laundry.

When the rotational speed of the motor is decelerated to the first speed S1, the motor-driving unit 260 immediately accelerates the rotational speed of the motor to the second speed S2 again at a fourteenth time t14 with no maintenance period B. When the rotational speed of the motor reaches the second speed at a fifteenth time t15, the motor-driving unit 260 decelerates the rotational speed of the motor to the first speed S1. The motor-driving unit 260 repeats acceleration and deceleration a predetermined number of times, and then stops the motor (t19).

The current-sensing unit 280 measures current in the acceleration period d14 and the deceleration period d15. The controller 210 calculates the average of the received current values on a per-period basis to determine the amount of laundry.

Figure 8:
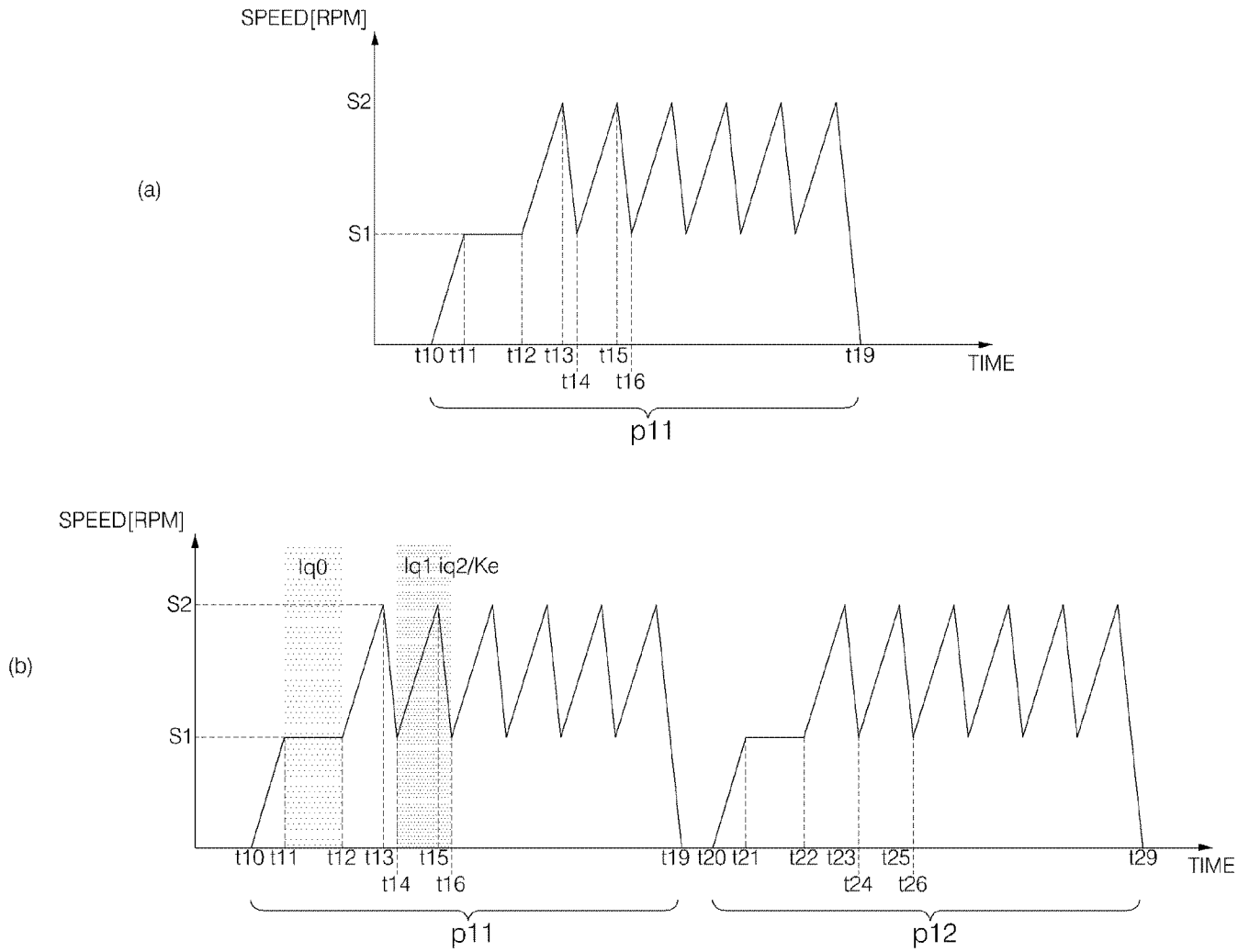
FIG. 8 is a reference view illustrating another method of measuring the amount of laundry using a change in the speed of the motor shown in FIG. 7.

FIG. 8 is a reference view illustrating another method of measuring the amount of laundry using a change in the speed of the motor shown in FIG. 7. After the motor is started, the controller 210 maintains the rotational speed of the motor at the first speed S1 for a predetermined amount of time to set an initial maintenance period, and then perform control to increase or decrease the rotational speed of the motor within a range of the first speed to the second speed with no maintenance period. The controller 210 performs control such that the rotational speed of the motor is decelerated with no maintenance period and is then rapidly accelerated, thereby maximizing inertia information in the acceleration period.

As shown in FIG. 8(*a*), in response to the control command from the controller, therefore, the motor-driving unit 260 starts the motor at the tenth time t10 to accelerate the rotational speed of the motor to the first speed S1, maintains the rotational speed of the motor during the maintenance period of the eleventh to twelfth times t11 to t12, accelerates the motor from the first speed S1 to the second speed for an amount of time ranging from time ranging from the twelfth to nineteenth times t12 to t19, and decelerates the rotational speed of the motor to the first speed, which is repeated a predetermined number of times.

When the rotational speed of the motor is decelerated to the first speed S1, the motor-driving unit 260 immediately accelerates the rotational speed of the motor to the second speed S2 with no maintenance period B, repeats acceleration and deceleration a predetermined number of times, and then stops the motor at the nineteenth time t19. The motor-driving unit 260 may repeat acceleration and deceleration 5 to 7 times.

After the rotational speed of the motor is maintained at the first speed for a predetermined amount of time, the controller 210 repeats acceleration and deceleration, and primarily determines the amount of laundry based on the current values in the maintenance period, the acceleration period, and the deceleration period. The controller 210 sets an amount of time ranging from the tenth to nineteenth times t10 to t19 to a primary determination period P11.

After determining the amount of laundry, the controller 210 determines whether the amount of laundry is small. Upon determining that the amount of laundry is small, the controller 210 confirms the amount of laundry and controls the motor-driving unit to perform the next operation. Meanwhile, upon determining that the amount of laundry is not small, the controller 210 changes the rotational direction of the motor and performs the above operation once again.

The controller 210 changes the rotational direction of the motor to reduce variation in the measured amount of laundry, thereby improving precision. In addition, the controller 210 may change the rotational direction of the motor to secondarily determine the amount of laundry. In this case, the laundry may be untangled, thereby providing the laundry untangling effect.

As shown in FIG. 8(*b*), after the primary determination period P11, upon determining that the amount of laundry is not small, the controller 210 changes the rotational direction of the motor, and transmits a control command for controlling the rotational direction of the motor to the motor-driving unit during a secondary determination period P12.

In response to the control command, the motor-driving unit 260 changes the rotational direction of the motor, accelerates the rotational speed of the motor to the first speed (t20 to t21), and maintains the rotational speed of the motor at the first speed for a predetermined amount of time t21 to t22 (maintenance period). After the twenty-second time t22, the motor-driving unit 260 accelerates the rotational speed of the motor to the second speed and decelerates the rotational speed of the motor to the first speed S1, which is repeated, and stops the operation at a twenty-ninth time t29.

After the rotational speed of the motor is changed, the current-sensing unit 280 measures current values in the maintenance period, the acceleration period, and the deceleration period, and transmits the measured current values to the controller 210. At this time, the current-sensing unit 280 may continuously measure current in the maintenance period and the acceleration period, and may measure current in a portion of the deceleration period. The measurement time may be changed depending on the length (time) of the deceleration period. In the case in which current is measured in a portion of the deceleration period, the current is measured at the beginning of the deceleration period.

The controller 210 calculates the averages of the current values for the respective periods in the primary determination period P11 and the current values for the respective periods in the secondary determination period P12 to determine the amount of laundry. The controller 210 analyzes current in the acceleration period and the deceleration period and current in the maintenance period based on different data.

The controller 210 multiplies the averages of the current values for the respective periods by counter-electromotive force to calculate the amount of laundry. The amount of laundry in the acceleration period is determined based on the laundry amount data for the inertial torque, and the amount of laundry in the maintenance period is determined based on the laundry amount data for on the gravitational torque. In addition, since the characteristics of the motor based on the kind or performance of the motor are reflected in the counter-electromotive force, the counter-electromotive force is used in calculating the amount of laundry in order to compensate for the same.

After determining the amount of laundry, the controller 210 controls the motor-driving unit to perform the next operation based on the determined amount of laundry. In addition, the controller 210 may set a limit value for unbalance based on the amount of laundry. For example, the controller 210 sets the maximum spin-drying speed based on the amount of laundry, and transmits a control command to the motor-driving unit 260. As a result, the drum is rotated at the set maximum spin-drying speed to perform spin drying. Here, the spin drying includes spin drying after washing, spin drying after rinsing, and final spin drying.

Figure 9:
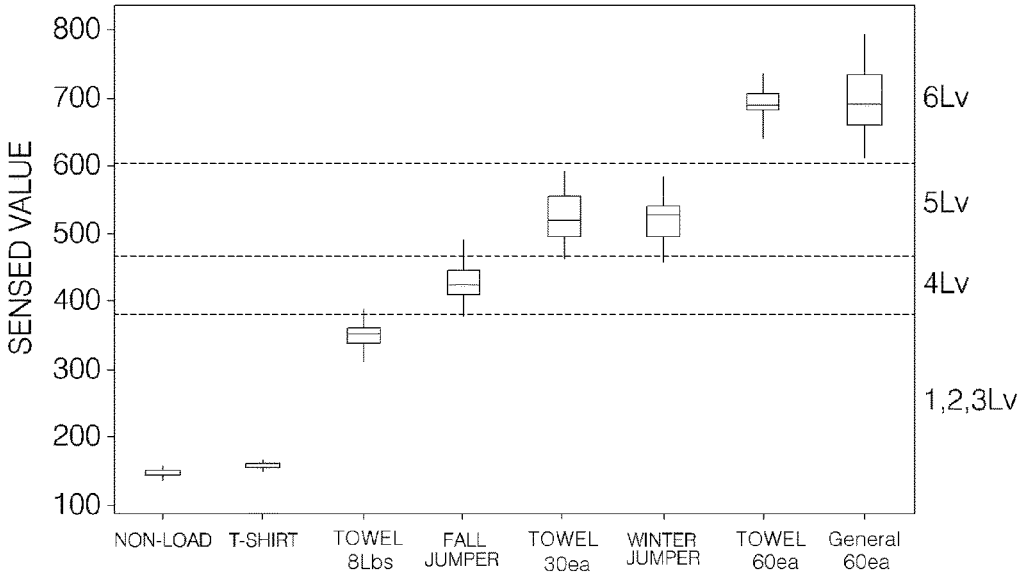
FIG. 9 is a view showing the results of measurement of the amount of laundry based on the kind of laundry in the washing machine according to the present disclosure.
Figure 9:
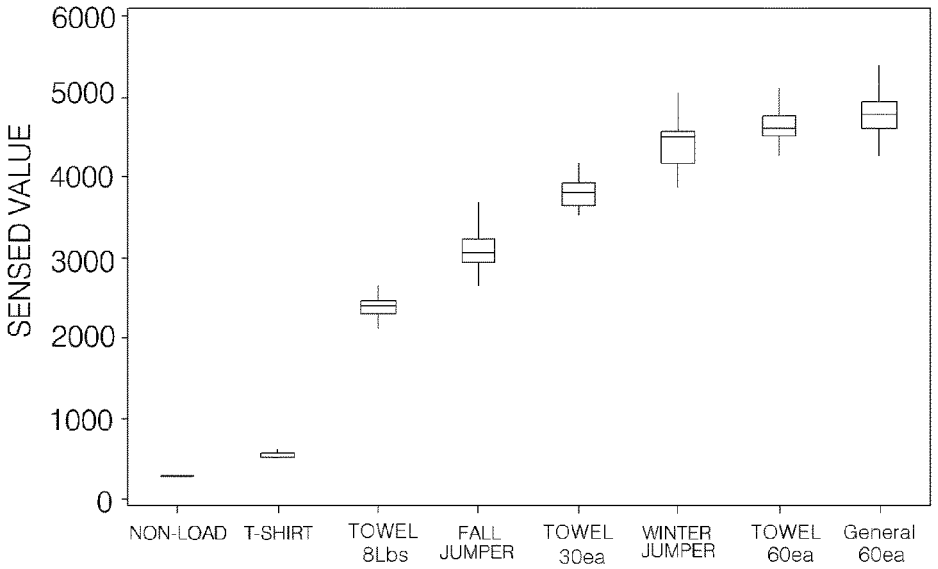

FIG. 9 is a view showing the results of measurement of the amount of laundry based on the kind of laundry in the washing machine according to the present disclosure. FIG. 9(*a*) is a view showing laundry-amount sensing values for respective kinds of laundry according to a conventional laundry amount determination method, and FIG. 9(*b*) is a view showing laundry-amount sensing values for respective kinds of laundry according to a laundry amount determination method of the present disclosure.

As shown in FIG. 9(*a*), in the conventional washing machine, it is not possible to distinguish between an unloaded state and a T-shirt when determining the amount of laundry. In addition, the ranges of the sensed values of a fall jumper, a heavy towel, and a winter jumper overlap each other, and therefore it is difficult to distinguish therebetween. Furthermore, the distribution of the sensed values increases as the amount of laundry increases, whereby it is difficult to determine the amount of laundry.

In contrast, as shown in FIG. 9(*b*), in the washing machine according to the present disclosure, error depending on the characteristics of the motor is compensated for based on the current values in the maintenance period, the acceleration period, and the deceleration period, in consideration of the characteristics of the gravity and inertia, and using the counter-electromotive force, whereby it is easier to distinguish between the sensed values based on the kinds of laundry.

Figure 10:
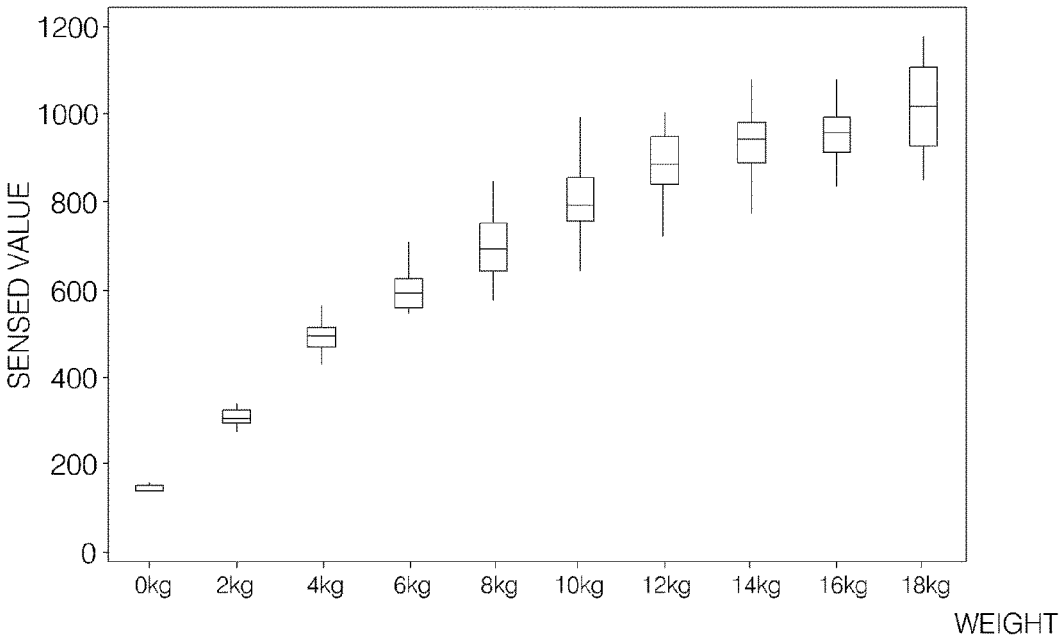
FIG. 10 is a view showing the results of measurement of the amount of laundry based on the weight of laundry in a conventional washing machine.

FIG. 10 is a view showing the results of measurement of the amount of laundry based on the weight of laundry in the conventional washing machine. As shown in FIG. 10, the conventional washing machine determines the amount of laundry using a current value measured at the time of starting the motor.

In the conventional washing machine, the sensed values for laundry having a weight of 6 kg or more are distributed in an overlapping manner, whereby it is difficult to determine an amount of laundry having a weight of 6 kg or more. For example, in the case in which the laundry-amount sensing value, determined based on the current value, is 600, it is difficult to determine whether the weight of the laundry contained in the drum is 6 kg or 8 kg.

Also, in the case in which the laundry-amount sensing value is 900, it is difficult to specify the weight of the laundry contained in the drum, since laundry articles having a weight of 12 kg to 18 kg have the same distribution. Consequently, it is difficult to determine an amount of laundry having a weight of 8 kg or more.

Figure 11:
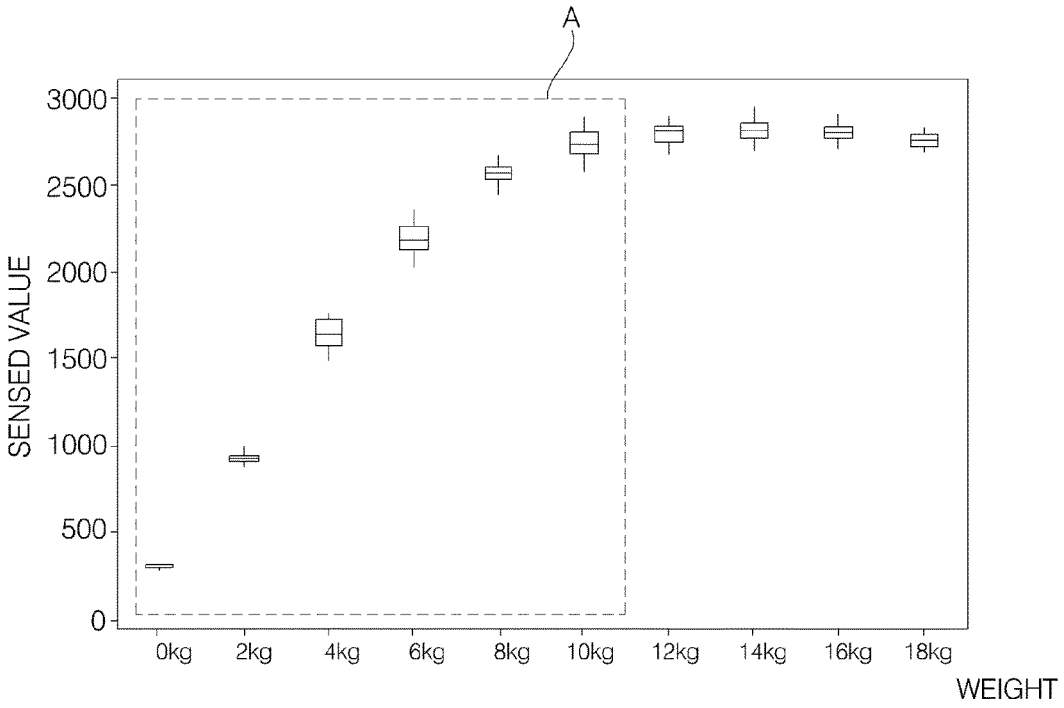
FIG. 11 is a view showing the results of measurement of the amount of laundry based on small and intermediate amounts of laundry in the washing machine according to the present disclosure.
Figure 12:
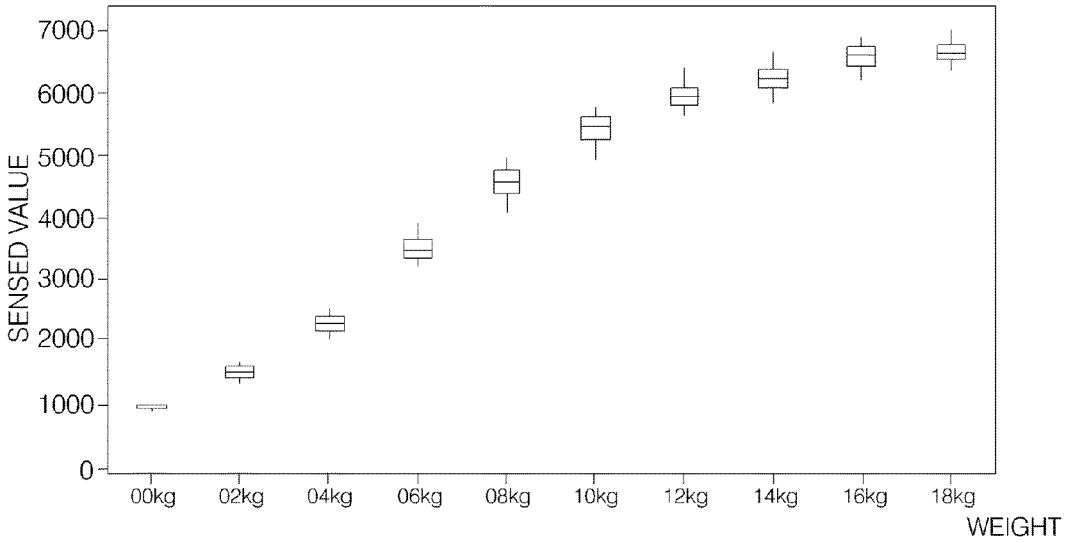
FIG. 12 is a view showing the results of measurement of the amount of laundry based on the weight of laundry in the washing machine according to the present disclosure.

FIG. 11 is a view showing the results of measurement of the amount of laundry based on small and intermediate amounts of laundry in the washing machine according to the present disclosure, and FIG. 12 is a view showing the results of measurement of the amount of laundry based on the weight of laundry in the washing machine according to the present disclosure.

As shown in FIG. 11, the washing machine according to the present disclosure determines the amount of laundry based on a current value in a low-speed maintenance period. Consequently, laundry-amount sensing values based on the weight of laundry are measured for small and intermediate amounts of laundry having a weight of 8 kg or less, whereby it is possible to precisely determine the amount of laundry.

When the amount of laundry is determined using the low-speed maintenance period, however, it is difficult to distinguish between the laundry-amount sensing values as the weight of laundry increases. Consequently, the amount of laundry is determined using the characteristics of inertia in acceleration and deceleration periods, in which the motor is rotated at a higher speed than in the maintenance period.

As shown in FIG. 12, therefore, the amount of laundry is determined based on the current values in the maintenance period, the acceleration period, and the deceleration period, whereby it is easy to distinguish between the laundry-amount sensing values for the respective weights of laundry.

Figure 13:
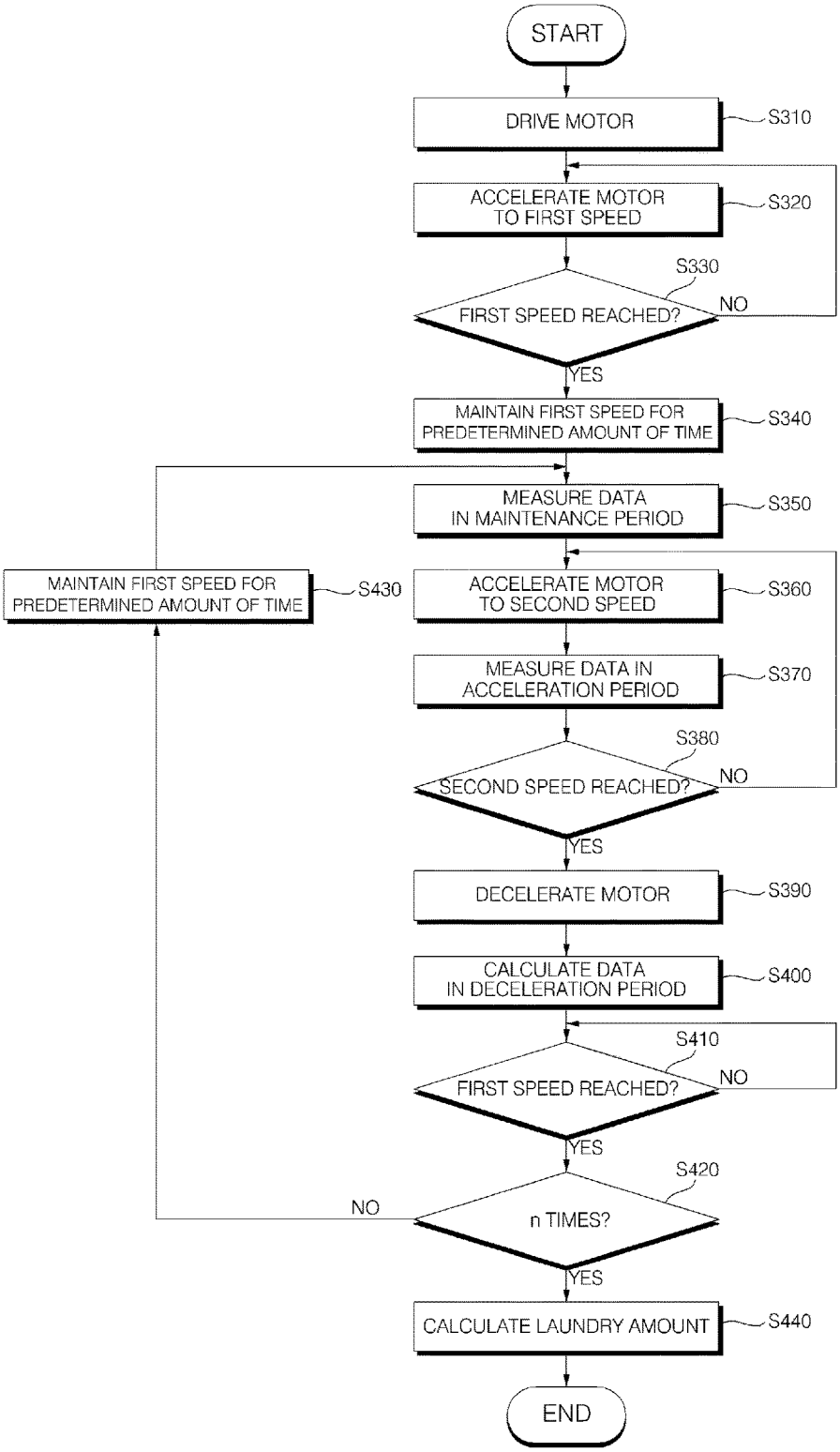
FIG. 13 is a flowchart showing a control method for measuring the amount of laundry in the washing machine according to the present disclosure.

FIG. 13 is a flowchart showing a control method for measuring the amount of laundry in the washing machine according to the present disclosure. As shown in FIG. 13, when washing is commenced, the controller 210 senses the amount of laundry before commencing high-speed spin drying. In order to sense the amount of laundry, the controller 210 transmits a control command for controlling the motor to the motor-driving unit 260.

In response to the control command from the controller 210, the motor-driving unit 260 supplies operating power to the motor 270, and the motor is driven (S310). The drum, which is connected to the motor, is rotated as the motor is driven, and laundry in the drum moves as the drum is rotated.

The motor-driving unit 260 starts the motor 270, which is in a stationary state, and accelerates the rotational speed of the motor 270 to a first speed (S320). Here, the first speed is a rotational speed at which the laundry does not cling to the wall of the drum but tumbles in the drum.

When the rotational speed of the motor 270 reaches the first speed (S330), the motor-driving unit 260 maintains the rotational speed of the motor 270 at the first speed for a predetermined amount of time (S340). For example, the first speed may be set in the range from 30 rpm to 40 rpm. While the rotational speed of the motor 270 is maintained at the first speed, the current-sensing unit 280, which is connected to the motor, measures the current of the motor and transmits the measured current to the controller 210 (S350).

After the lapse of the predetermined amount of time, the motor-driving unit 260 accelerates the rotational speed of the motor 270 to a second speed (S360). Here, the second speed is a rotational speed at which some of the laundry rotates along with the drum in the state of clinging to the wall of the drum by centrifugal force generated in the drum as the rotational speed of the motor increases and some of the laundry is lifted up and dropped by the rotation of the drum. For example, the second speed may be set in the range from 60 rpm to 80 rpm. The first speed and the second speed may be changed depending on the size of the drum and the kind and performance of the motor.

During an acceleration period, in which the motor is accelerated from the first speed to the second speed, the current-sensing unit 280 measures the current of the motor and transmits the measured current to the controller 210 (S370). When the rotational speed of the motor 270 reaches the second speed (S380), the motor-driving unit 260 brakes the motor to decelerate the rotational speed of the motor (S390). At this time, during a deceleration period, in which the motor is decelerated by braking the motor, the current-sensing unit 280 measures the current of the motor and transmits the measured current to the controller 210 (S400).

The motor-driving unit 260 decelerates the rotational speed of the motor to the first speed (S410), and counts the number of times acceleration and deceleration are performed in order to determine whether a predetermined number of times n has been reached (S420).

After the rotational speed of the motor reaches the first speed, the motor-driving unit 260 maintains the rotational speed of the motor at the first speed for a predetermined amount of time (S430). The current-sensing unit 280 measures the current of the motor in a maintenance period, in which the rotational speed of the motor is maintained at the first speed, and transmits the measured current to the controller 210 (S350). The time during which the first speed is maintained after deceleration may be different from the time during which the first speed is maintained after starting.

The motor-driving unit 260 performs control such the rotational speed of the motor is accelerated, decelerated, and maintained between the first speed and the second speed, which is repeated a predetermined number of times (S350 to S420). The rotational speed of the motor is repeatedly accelerated, decelerated, and maintained according to the operating power received from the motor-driving unit 260, and, when the predetermined number of times has been reached, the operation of the motor is stopped.

The controller 210 calculates the average of the current values measured in each of the maintenance, acceleration, and deceleration periods according to the rotational speed of the motor, and determines the amount of laundry using counter-electromotive force calculated in the deceleration period (S440).

Figure 14:
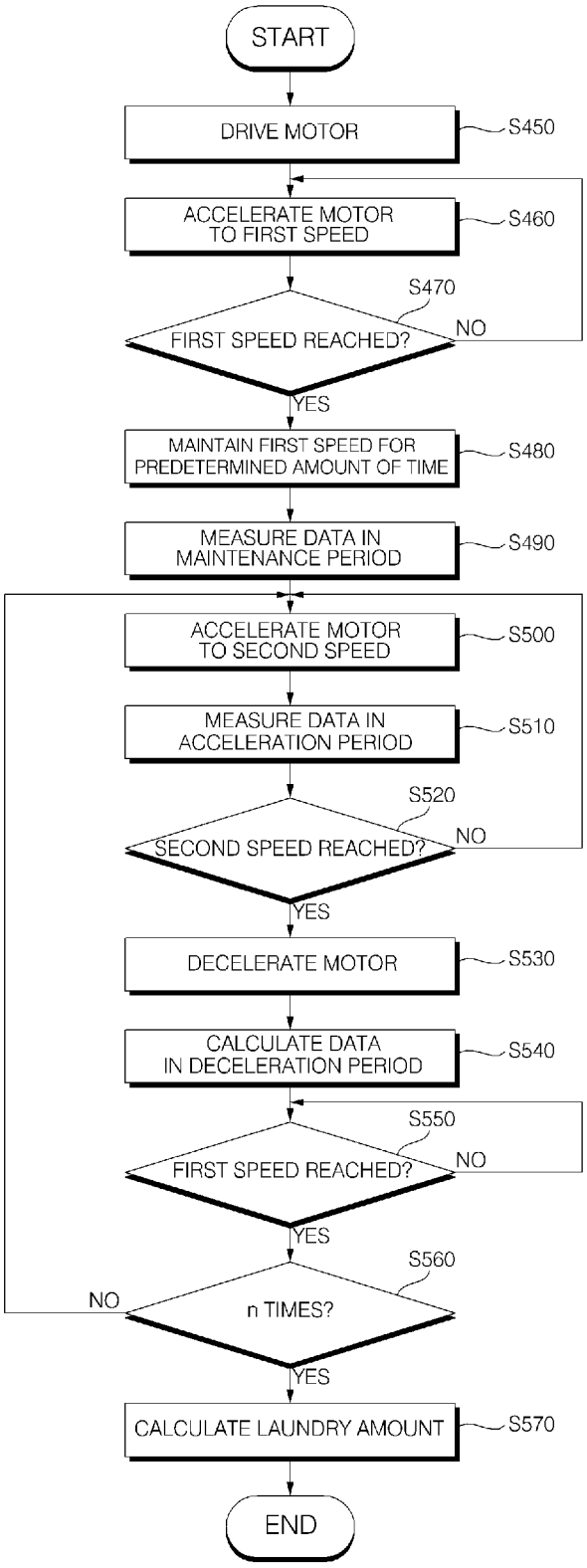
FIG. 14 is a flowchart showing another example of the control method for measuring the amount of laundry in the washing machine according to the present disclosure.

FIG. 14 is a flowchart showing another example of the control method for measuring the amount of laundry in the washing machine according to the present disclosure. As shown in FIG. 14, when washing is commenced, the controller 210 senses the amount of laundry before commencing high-speed spin drying. In order to sense the amount of laundry, the controller 210 transmits a control command for controlling the motor to the motor-driving unit 260. The controller 210 divides a maintenance period, an acceleration period, and a deceleration period from each other based on the rotational speed of the motor, and generates a control command for rotating the motor and repeatedly accelerating and decelerating the motor. When the rotational speed of the motor is reduced by braking the motor, the controller 210 generates a control command for immediately accelerating the motor instead of maintaining the speed of the motor.

In response to the control command from the controller 210, the motor-driving unit 260 supplies operating power to the motor 270, and the motor is driven (S450). The drum, which is connected to the motor, is rotated as the motor is driven, and laundry in the drum moves as the drum is rotated.

The motor-driving unit 260 starts the motor 270, which is in a stationary state, and accelerates the rotational speed of the motor 270 to a first speed (S320). Here, the first speed and a second speed may be set depending on the state of the laundry in the drum, as previously described.

When the rotational speed of the motor 270 reaches the first speed (S470), the motor-driving unit 260 maintains the rotational speed of the motor 270 at the first speed for a predetermined amount of time (S480). While the rotational speed of the motor 270 is maintained at the first speed, the current-sensing unit 280 measures the current of the motor and transmits the measured current to the controller 210 (S490).

After the lapse of a predetermined amount of time, the motor-driving unit 260 accelerates the rotational speed of the motor 270 to a second speed (S500). During an acceleration period, in which the motor is accelerated from the first speed to the second speed, the current-sensing unit 280 measures the current of the motor and transmits the measured current to the controller 210 (S510).

When the rotational speed of the motor 270 reaches the second speed (S520), the motor-driving unit 260 brakes the motor to decelerate the rotational speed of the motor (S530).

At this time, during a deceleration period, in which the motor is decelerated by braking the motor, the current-sensing unit 280 measures the current of the motor and transmits the measured current to the controller 210 (S540). When the rotational speed of the motor reaches the first speed (S550), the motor-driving unit 260 counts the number of times acceleration and deceleration have been performed in order to determine whether a predetermined number of times n has been reached (S560).

Upon determining that the predetermined number of times has not been reached, the motor-driving unit 260 accelerates the rotational speed of the motor to the second speed with no maintenance period (S500). When the rotational speed of the motor reaches the second speed (S520), the motor-driving unit 260 performs control such that the rotational speed of the motor is decelerated to the first speed (S530). The current-sensing unit 280 measures the current of the motor in the acceleration period and the deceleration period, and transmits the measured current of the motor to the controller 210 (S510 and S540).

The motor-driving unit 260 repeatedly accelerates and decelerates the motor a predetermined number of times (S500 to S560) and stops the motor. The controller 210 maintains the rotational speed of the motor at the first speed once at the initial stage, controls the motor to be repeatedly accelerated and decelerated with no maintenance period, and determines the amount of laundry based on the current measured in the initial maintenance period, the current repeatedly measured in the acceleration period and the deceleration period, and the counter-electromotive force in the deceleration (S570).

After the motor is decelerated, the controller 210 controls the motor to be immediately accelerated instead of maintaining the speed of the motor such that the characteristics of inertia in the acceleration period are improved, and therefore precision of the laundry-amount sensing value for each weight of the laundry is improved.

Figure 15:
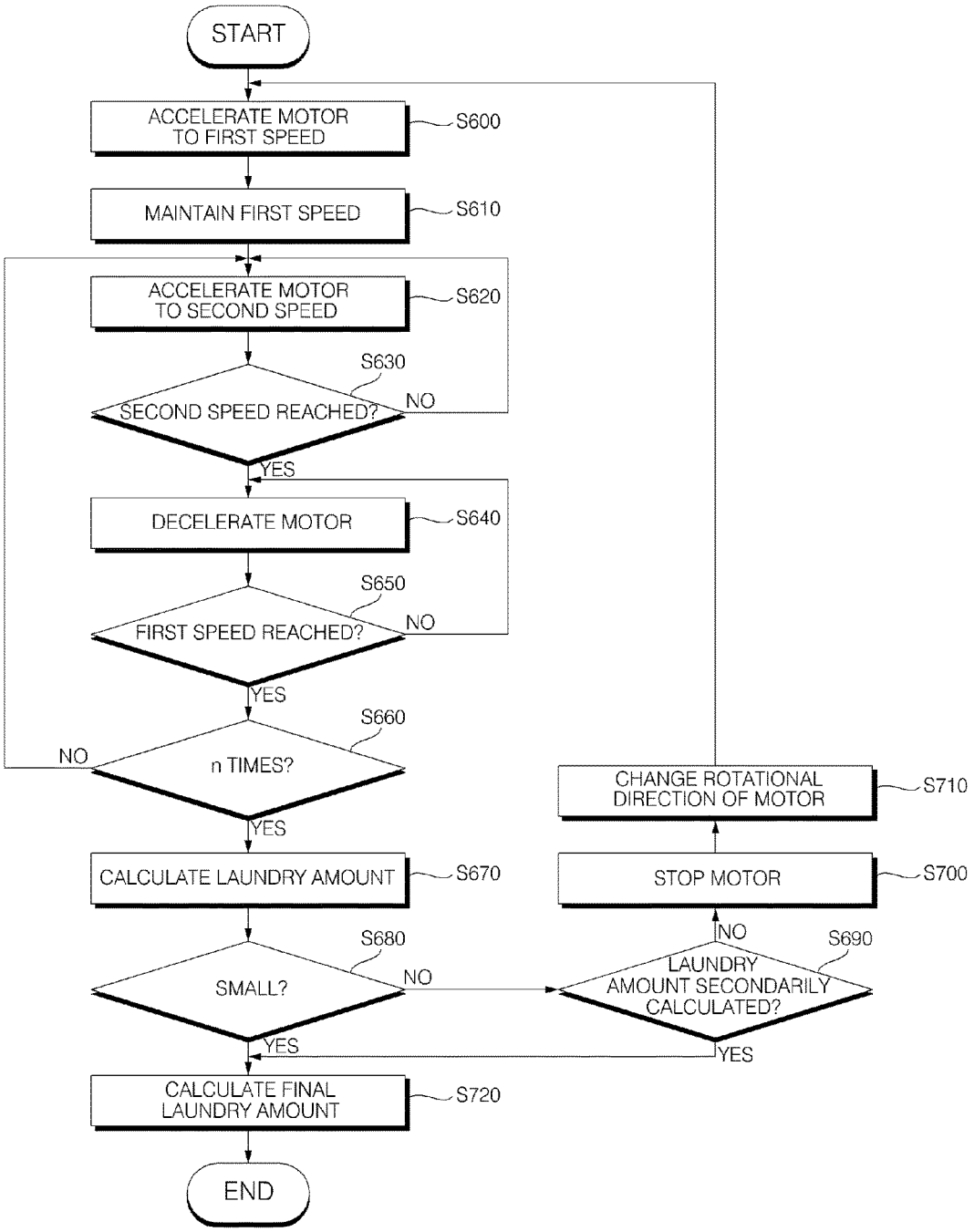
FIG. 15 is a flowchart showing a control method for measuring the amount of laundry by changing the rotational direction of the motor in the washing machine according to the present disclosure.

FIG. 15 is a flowchart showing a control method for measuring the amount of laundry by changing the rotational direction of the motor in the washing machine according to the present disclosure. As shown in FIG. 15, in order to determine the amount of laundry, the controller 210 transmits a control command for controlling the motor to the motor-driving unit 260.

After the motor 270 starts in response to the control command, the motor-driving unit 260 maintains the rotational speed of the motor at a first speed for a predetermined amount of time, and controls the motor to be repeatedly accelerated and decelerated (S600 to S660). While the rotational speed of the motor is maintained, accelerated, and decelerated, the current-sensing unit measures the current of the motor and transmits the measured current of the motor to the controller.

At this time, the motor is operated in the same manner as shown in FIG. 13 or 14. Whether the rotational speed of the motor is maintained after deceleration may be changed depending on a setting value. The controller 210 determines the amount of laundry based on current values measured in a maintenance period, in which the rotational speed of the motor is maintained, an acceleration period, in which the rotational speed of the motor is increased, and a deceleration period. in which the rotational speed of the motor is decreased, and on the counter-electromotive force (S670).

The controller 210 determines whether the determined amount of laundry is small (S680). Upon determining that the determined amount of laundry is small, the controller 210 sets the determined amount of laundry to the final laundry amount, and finishes the operation for determining the amount of laundry. Upon determining that the determined amount of laundry is not small, the controller 210 determines how many times the laundry amount has been calculated. In the case in which the amount of laundry has been determined twice or more, the controller 210 sets the calculated laundry amount to the final laundry amount (S720).

Meanwhile, in the case in which the amount of laundry is not small and the laundry amount has been calculated once, the controller stops the motor (S700) in order to improve precision in determining the amount of laundry, and the controller controls the motor-driving unit 260 such that the rotational direction of the motor is changed and secondary laundry amount determination is commenced.

In response to the control command, the motor-driving unit 260 changes the rotational direction of the motor (S710), accelerates the motor until the rotational speed of the motor reaches the first speed (S600), maintains the rotational speed of the motor at the first speed (S610), and accelerates the motor until the rotational speed of the motor reaches the second speed (S620). When the rotational speed of the motor reaches the second speed (630), the motor-driving unit 260 brakes the motor to decelerate the rotational speed of the motor to the first speed (S640), and, when the rotational speed of the motor reaches the first speed, accelerates the motor again, which is repeated a predetermined number of times (S620 to S670).

The controller 210 secondarily determines the amount of laundry based on data in the maintenance period, the acceleration period, and the deceleration period for the current value, measured by the current-sensing unit during the operation of the motor (S670). The controller 210 synthesizes the data in the primary determination period and the data in the secondary determination period to calculate the final laundry amount (S720).

In the present disclosure, therefore, the current of the motor at the time of starting the motor is not measured, but the current of the rotating motor in the maintenance period, in which the rotational speed of the motor is maintained, the acceleration period, and the deceleration period, and counter-electromotive force is calculated in order to determine the amount of laundry. Consequently, it is possible to exclude instability of the current at the time of starting the motor, to minimize variation due to the movement of the laundry, and to more precisely determine the amount of laundry using the characteristics of inertia.

As is apparent from the above description, in the washing machine according to the present disclosure and the method of controlling the same, the amount of laundry that is introduced into the washing machine is measured using gravity and inertia applied during the operation of the motor, whereby it is possible to precisely calculate the amount of laundry and to minimize the effects of the initial position of the laundry and the movement of the laundry. In addition, the current value of the motor that is operated is used to measure the amount of laundry without a sensor. Furthermore, precision in determining the amount of laundry is improved, and the amount of laundry is determined within a short time. Consequently, it is easy to commence the spin-drying operation, thereby reducing washing time and saving energy.

Therefore, the present disclosure has been made in view of the above problems, and the present disclosure provides a washing machine capable of rapidly and precisely determining the amount of laundry that is introduced thereinto, precisely measuring the amount of laundry even in the case in which the washing machine includes a sensorless motor, and easily performing a spin-drying operation based on the amount of laundry, thereby reducing washing time, and a method of controlling the same.

In accordance with an aspect of the present disclosure, a washing machine includes a motor connected to a drum for rotating the drum, a motor-driving unit for supplying operating power to the motor to operate or stop the motor and to control the rotational speed of the motor, a current-sensing unit for measuring current of the motor during operation of the motor, and a controller for transmitting a control command for controlling the motor to the motor-driving unit in order to determine the amount of laundry contained in the drum and determining the amount of laundry based on a current value received from the current-sensing unit, wherein the motor-driving unit controls the motor such that the rotational speed of the motor is repeatedly maintained, accelerated, and decelerated within a predetermined range of speed in response to the control command, and the controller divides the current value received from the current-sensing unit into current values in a maintenance period, in which the rotational speed of the motor is maintained, an acceleration period, and a deceleration period, which are divided based on rotation of the motor, and analyzes the current value on a per-period basis to calculate the amount of laundry.

In accordance with another aspect of the present disclosure, there is provided a method of controlling a washing machine that includes starting a motor and accelerating the motor to a first speed in order to determine the amount of laundry contained in a drum (a starting step), rotating the motor at the first speed for a predetermined amount of time (a maintenance step), accelerating the motor to a second speed after the predetermined amount of time (an acceleration step), decelerating the motor to the first speed when a rotational speed of the motor reaches the second speed (a deceleration step), repeating the acceleration step and the deceleration step a predetermined number of times (a repetition step), and analyzing current values measured at the maintenance step, the acceleration step, and the deceleration step on a per-period basis to calculate the amount of laundry.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a motor to rotate a drum;

a power supply to provide operating power to the motor to selectively operate the motor and to control a rotational speed of the motor;

a current sensor to measure current of the motor during operation; and a controller to transmit a control command for controlling the motor to the power supply, and to determine an amount of laundry contained in the drum based on current measured by the current sensor, wherein:

the power supply provides the operating power to the motor such that the rotational speed of the motor is repeatedly maintained, increased, and decreased within a range between a first speed and a second speed in response to the control command, the motor accelerates until the rotational speed changes to the first speed, maintains the rotational speed at the first speed for a particular amount of time, accelerates until the rotational speed of the motor changes from the first speed to the second speed, and decelerates from the second speed back to the first speed, and the controller determines the amount of laundry contained in the drum based on respective currents measured by the current sensor during a maintenance period in which the rotational speed of the motor is maintained, an acceleration period in which the rotational speed of the motor increases, and a deceleration period in which the rotational speed of the motor decreases, and wherein, when determining the amount of laundry in the drum, the controller is further configured to:

determine an initial estimate of the amount of laundry in the drum based on currents measured while the motor operates in a first rotational direction, when the initial estimate of the amount of laundry is less than a threshold, determine that the amount of laundry corresponds to the initial estimate, and when the initial estimate of the amount of laundry is not less than the threshold, direct the motor to operate in a second rotational direction, and determine the amount of laundry based on the initial estimate and further based on currents measured while the motor operates in the second rotational direction.

2. The washing machine according to claim 1, wherein the power supply provides the operating power such that the motor is repeatedly accelerated and decelerated a particular number of times within the range between the first speed and the second speed.

3. The washing machine according to claim 1, wherein the power supply provides the operating power such that after the motor is decelerated from the second speed to the first speed:

the motor maintains the rotational speed at the first speed for an amount of time, and the motor accelerates until the rotational speed of the motor changes from the first speed to the second speed.

4. The washing machine according to claim 1, wherein the controller sets a rotational speed of the motor in which the laundry tumbles in the drum as the first speed, and sets another rotational speed of the motor in which the laundry starts to cling to a wall of the drum by centrifugal force generated in the drum, a portion of the laundry rotates along with the drum when clinging to the wall of the drum, and another portion of the laundry is lifted up and dropped by the rotation of the drum as the second speed.

5. The washing machine according to claim 1, wherein the controller determines the amount of laundry based on a gravitational force applied to the laundry in the maintenance period, inertia of the laundry in the acceleration period and the deceleration period, and counter-electromotive force applied in the deceleration period.

6. The washing machine according to claim 5, wherein the controller excludes data in the maintenance period, in which the rotational speed of the motor is maintained, from data in the acceleration period and the deceleration period, in which the rotational speed of the motor is changed, to extract data on the inertia in the acceleration period and the deceleration period.

7. The washing machine according to claim 5, wherein the controller subtracts current detected in the maintenance period from currents detected in the acceleration period and the deceleration period to form a first value, multiplies the first value by the counter-electromotive force to form a second value, and divides the second value by a variation of speed per unit time to extract data on the inertia of the laundry.

8. The washing machine according to claim 1, wherein the controller multiplies currents detected in the maintenance period, the acceleration period, and the deceleration period by a counter-electromotive force calculated in the deceleration period to calculate laundry-amount sensing values for determining the amount of laundry.

9. The washing machine according to claim 8, wherein the controller calculates the laundry-amount sensing values from averages of the currents detected in the maintenance period, the acceleration period, and the deceleration period.

10. The washing machine according to claim 8, wherein the controller determines the amount of laundry based on the laundry-amount sensing values in the acceleration period, the deceleration period, and the maintenance period using different data, and the controller compares the laundry-amount sensing values in the acceleration period and the deceleration period with the laundry-amount sensing value in the maintenance period to determine the amount of laundry.

11. The washing machine according to claim 1, wherein the rotational speed of the motor is varied in a repeated process in which the rotational speed is sequentially accelerated from the first speed to the second speed, and then decreased from the second speed to the first speed.

12. The washing machine according to claim 1, wherein the repeated process includes sequentially repeating the acceleration from the first speed to the second and the deceleration from the second speed to the first speed a particular number of times.

13. The washing machine according to claim 12, wherein the drum rotates in the first rotational direction during the repeated process, and another repeated process is performed in which in which the rotational speed is sequentially accelerated from the first speed to the second speed, and then decreased from the second speed to the first speed while the drum rotates in the second rotational direction that is opposite to the first rotational direction.

14. The washing machine according to claim 1, wherein the drum receives laundry via an opening on a front surface of the washing machine.

15. The washing machine according to claim 1, wherein the controller is further configured to manage a rotational speed of the drum during a spin-drying operation based on the amount of laundry contained in the drum.

16. The washing machine according to claim 15, wherein the controller is further configured to determine a maximum rotational speed of the drum during the spin-drying operation based on the amount of laundry contained in the drum.

17. The washing machine according to claim 1, wherein the controller is further configured to determine a limit value for unbalance during a spin-drying operation based on the amount of laundry contained in the drum.

18. The washing machine according to claim 1, wherein the motor accelerates by a first rate during a first portion of the acceleration period and accelerates by a second rate during a second portion of the acceleration period, the first rate being smaller than the second rate.

* * * * *